US006600266B1

(12) United States Patent
Nakagawa

(10) Patent No.: US 6,600,266 B1
(45) Date of Patent: Jul. 29, 2003

(54) MOUNT FOR LAMP AND LAMP SEAL STRUCTURE EMPLOYING THE MOUNT

(75) Inventor: Atsuji Nakagawa, Hyogo-ken (JP)

(73) Assignee: Phoenix Electric Co., Ltd., Himeji (JP)

( * ) Notice: Subject to any disclaimer, the term of this patent is extended or adjusted under 35 U.S.C. 154(b) by 291 days.

(21) Appl. No.: 09/609,062

(22) Filed: Jun. 30, 2000

(30) Foreign Application Priority Data

Jul. 2, 1999 (JP) ..... 11-189599
Jul. 2, 1999 (JP) ..... 11-189600

(51) Int. Cl.[7] ..... H01J 17/18
(52) U.S. Cl. ..... 313/623; 313/326
(58) Field of Search ..... 313/623, 624, 313/625, 626, 631, 326

(56) References Cited

U.S. PATENT DOCUMENTS 5,107,177 A 4/1992 Barthelmes et al. ..... 313/623
5,200,669 A * 4/1993 Dixon et al. ..... 313/623
5,374,872 A 12/1994 Balaschak et al. ..... 313/623
5,461,277 A 10/1995 Van Gennip et al. ..... 313/331
5,468,168 A 11/1995 Balaschak et al. ..... 445/26
5,598,063 A 1/1997 Mathews et al. ..... 313/623
6,181,064 B1 * 1/2001 Narita ..... 313/623
6,356,018 B1 * 3/2002 Higashimoto et al. ..... 313/623

* cited by examiner

*Primary Examiner*—Robert H. Kim
*Assistant Examiner*—Jurie Yun
(74) *Attorney, Agent, or Firm*—Oblon, Spivak, McClelland, Maier & Neustadt, P.C.

(57) ABSTRACT

It is an object of the present invention to assuredly prevent occurrence of minute cracks in a seal portion of a lamp for improvement of the pressure resistance and service life of the lamp. To achieve the object, there is provided a seal structure of a lamp including: (a) a lamp envelope having a light emitting tube and a seal portion; (b) a metal foil embedded in the seal portion of the lamp envelope; (c) a light emitting element attached to one of opposite ends of the metal foil and disposed in the light emitting tube; and (d) an outer lead rod attached to the other end of the metal foil and led out of the seal portion, the seal structure comprising a separable layer interposed between the seal portion and a portion of the light emitting element embedded in the seal portion.

15 Claims, 23 Drawing Sheets

MOUNT FOR LAMP AND LAMP SEAL STRUCTURE EMPLOYING THE MOUNT

BACKGROUND OF THE INVENTION

1. Field of the Invention

The present invention relates to a novel mount for a lamp which ensures an excellent pressure resistance and a longer service life of the lamp, and to a lamp seal structure employing the mount.

2. Description of the Prior Art

In recent years, ultra-high pressure mercury lamps having a high optical efficiency have gained an increasing share for use as light sources for optical systems (projectors, rear projection TV sets, fiber optics and the like). The ultra-high pressure mercury lamps generally have an internal pressure of not lower than 120 atm at illumination thereof for improvement of the optical efficiency. Some of the ultra-high pressure mercury lamps in production have an internal pressure of about 190 atm. With such a trend, it is very important to improve the pressure resistance of lamp envelopes.

Weak portions of a lamp envelope for use in such an ultra-high pressure mercury lamp are a tip tube trace (i.e., a seal-cut portion) which is formed by seal-cutting a tip tube after filling one or some kinds of required gas (e.g., Ar and Xe) and one or some required substances (e.g., Hg and metal halide) in a light emitting tube portion, and seal portions protruded from both sides of the light emitting tube portion in which a metal foil is embedded. The ultra-high pressure mercury lamp employs a well-known method for producing a tipless type lamp which is free from the generally weak seal-cut trace. However, the seal portions cannot be eliminated. Therefore, the pressure resistance of the seal portions which contain the metal foils directly embedded therein and ensure gas-tight sealing is the most important requirement for the production of the ultra-high pressure mercury lamp.

Ultra-high pressure mercury lamps with an internal pressure of about 190 atm have already been in production. The only method for improvement of the pressure resistance of seal portions of such an ultrahigh pressure mercury lamp is to improve the tightness of the contact between a metal foil embedded in the seal portion and the glass constituting the seal portions of the lamp envelope having a greater thickness. This is achieved by heating the thick seal portion and keeping the inner part of the seal portions at a higher temperature for a longer period.

However, the very thin metal foil embedded in the seal portion is subjected to the high temperature for a long period, during the heating thereby it has a reduced mechanical strength, when the seal portion is heated to be softened in this state and then pressed from opposite sides in dies for pinch-sealing thereof or allowed to be shrunk for shrink-sealing thereof, for example, the weakened metal foil is distorted and, in the worst case, broken due to flow of the glass during the sealing, so that the yield is remarkably reduced by the sealing. In the case of the tipless lamp envelope which has no tip tube, one end of the lamp envelope is first sealed and, after one or some kinds of required gas and one or some required substances are filled in the light emitting tube portion, the other end of the lamp envelope is sealed. After the second sealing, a pressure resistance test cannot be performed on the tipless lamp envelope (in the case of the lamp envelope provided with the tip tube, the pressure resistance test is conventionally performed by charging a high pressure gas into the light emitting tube portion through the tip tube before one or some kind of required gas and the required substances are filled in the light emitting tube portion after the sealing). Accordingly, some of seemingly acceptable lamps have a low pressure resistance, so that the product reliability is reduced by them.

Even if the metal foil is kept in intimate contact with the glass of the seal portion in the aforesaid manner, another weak point resides in the seal portion. That is, a multiplicity of minute cracks occur in the seal portion at cooling after the sealing. More specifically, as the seal portion is cooled after the completion of the sealing, a difference in contraction occurs between the glass seal portion and rod portions (e.g., electrode rods and in-lead rods connected to a filament) of a light emitting element, which are embedded in the seal portion and each have a volume, so that the rod portions which have firmly adhered to the glass seal portions are separated from contact surfaces of the seal portions. At this time, the minute cracks are produced in the contact surfaces.

The multiplicity of minute cracks occurring in the seal portion are developed little by little by repetitive turn on and off of the lamp. Consequently, burst of the lamp is started from the cracks thus developed, resulting in breakage of the seal portion. The risk of the burst of the lamp is increased as the internal pressure of the light emitting tube portion is increased. For further size reduction, higher optical efficiency and longer service life of the lamp of this type (metal halide lamp, halogen lamp and the like), it is inevitable to increase the internal pressure of the light emitting tube portion. Therefore, prevention of the minute cracks in the seal portion is critical. That is, the tightness of the contact between the seal portion and the metal foil profoundly influences the pressure resistance, while the minute cracks in the seal portion profoundly influences the product service life.

Moreover, there is a demand for further improvement of light distribution from the lamp mounted in a system, so that highly accurate centering of the lamp with respect to the system is required.

SUMMARY OF THE INVENTION

In view of the foregoing, it is an object of the present invention to provide a mount for a lamp and a highly pressure-resistant and longer-life lamp employing the mount, which feature a very high pressure resistance, a longer service life and a higher production yield with no possibility of deformation or breakage of a metal foil at sealing, and ensure easier centering of a light emitting element with respect to a lamp envelope to meet the demand for further improvement of the light distribution.

First means for achieving the aforesaid object is to provide a separable layer on a surface of a portion of a light emitting element such as in-lead rods or electrodes to be embedded in seal portions of a lamp.

With this arrangement, if the in-lead rods or electrodes of the light emitting elements contract to a greater extent than the seal portions of a glass at a cooling stage after sealing and minute gaps occur therebetween, the separable layers provided on the surface of the portions embedded in the seal portions adhere onto inner surface of the seal portions and are easily separated from the embedded portions (or from the inner surface of the seal portions), thereby preventing occurrence of minute cracks on the inner surface of the seal portions. As a result, the pressure resistance of the seal portion can remarkably be enhanced, and the service life of the lamp can remarkably be extended because the pressure resistance of the lamp can drastically be increased.

Second means for achieving the aforesaid object is to embed a metal foil in a glass bead and then embed the metal foil with the glass bead in a seal portion provided at both ends of a lamp envelope for sealing. With this arrangement, a stress generated by flow of the glass melted at the sealing is not directly exerted on the metal foil, so that the deformation and breakage of the metal foil is less liable to occur at the sealing.

Third means for achieving the aforesaid object is to embed and seal a glass rod block with a light emitting element (i.e., in-lead rod with a filament or electrode rod) fitted in a bore formed in one end of the glass rod block and with an outer lead rod fitted in a bore formed in another end of the glass rod block in each seal portion of a lamp envelop. With this arrangement, the light emitting element can easily be centered with respect to the lamp envelope.

DETAILED DESCRIPTION OF THE PREFERRED EMBODIMENTS

Figure 1:
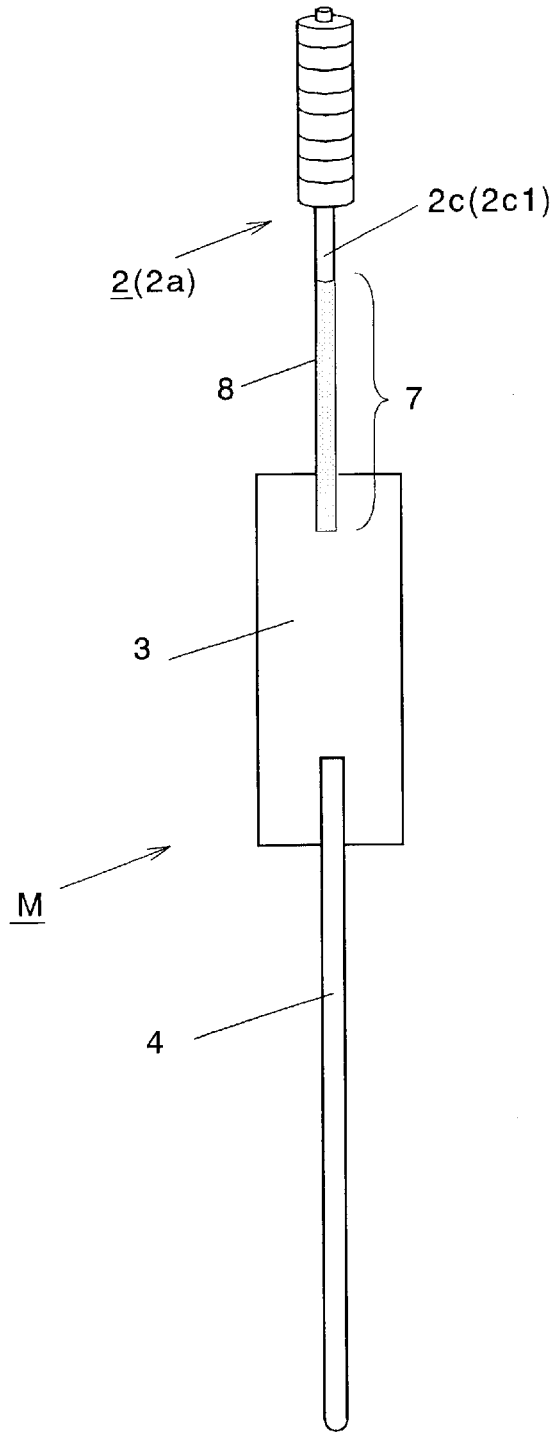
FIG. 1 is a front view of an electrode mount according to a first embodiment of the present invention.

A lamp A according to the present invention may be a lamp (e.g., a halogen lamp) which employs a filament 2*b,* or a lamp (e.g., a metal halide lamp, a ultra-high pressure mercury lamp) which employs a pair of opposed electrodes 2*a.* Although an explanation will be given mainly to the lamp employing the pair of opposed electrodes 2*a* in the following embodiments of the present invention, the invention is of course applicable to the lamp employing the filament 2*b* instead of the lamp employing the opposed electrodes 2*a.* There are two methods for filling one or some kinds of required gas and the required substances into a light emitting tube portion of a lamp envelope. One is a so-called tip tube method utilizing a tip tube 10 which is employed for filling one or some kinds of required gas and the required substances into a light emitting tube portion 1 of a lamp envelope 5. And the other is a so-called tipless method which does not utilize the tip tube 10. Even if an explanation is given only to a case employing the tip tube method but not to a case employing the tipless method in the following embodiments, the employment of the tipless method is possible, and vice versa.

Figure 10:
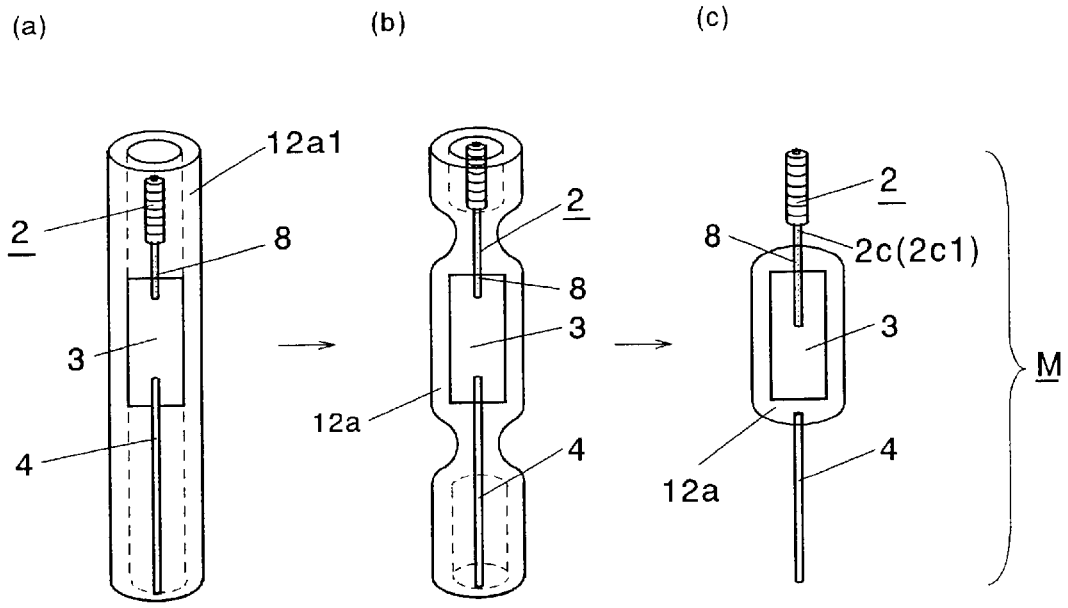
FIGS. 10(*a*) to 10(*c*) are process diagrams for explaining a production process for a beaded electrode mount according to a second embodiment of the present invention.
Figure 12:
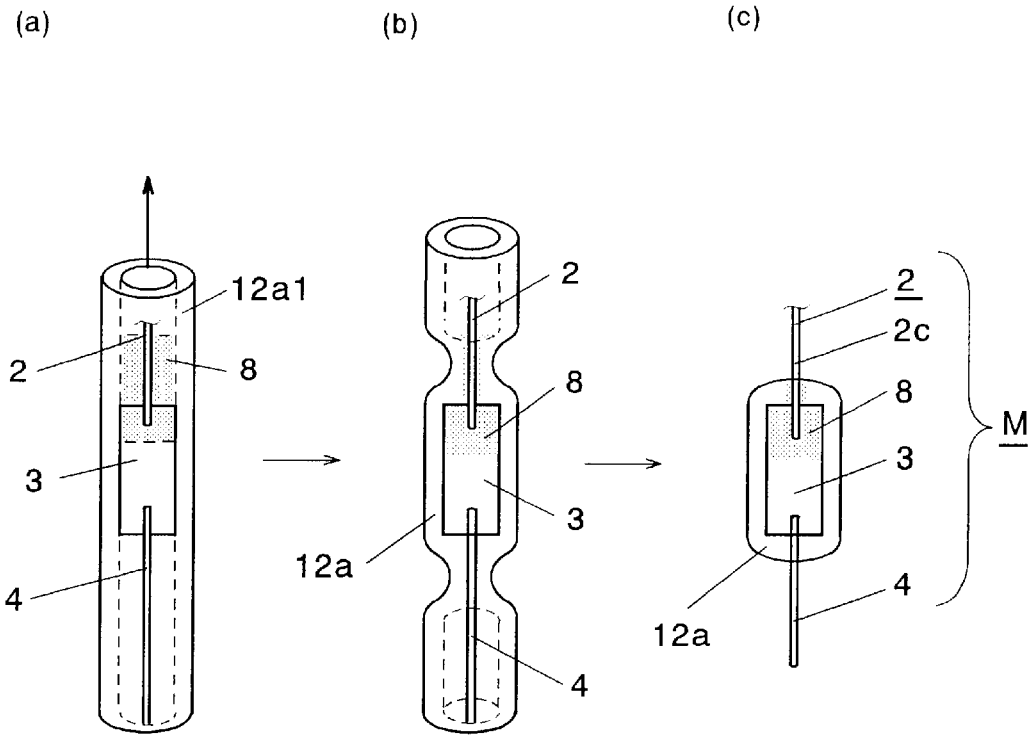
FIGS. 12(*a*) to 12(*c*) are process diagrams for explaining a production process for a beaded electrode mount in accordance with a modification of the second embodiment shown in FIGS. 10(*a*) to 10(*c*)
Figure 14:
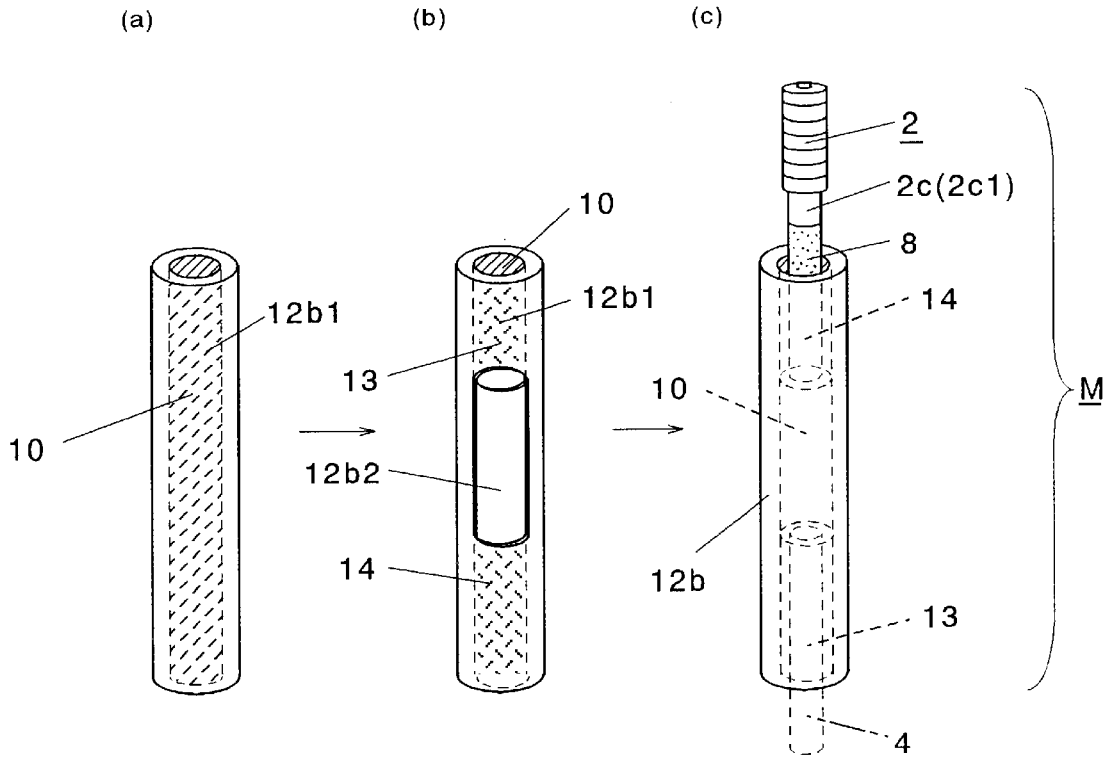
FIGS. 14(*a*) to 14(*c*) are process diagrams for explaining a production process for an electrode mount utilizing a glass rod block in accordance with a third embodiment of the present invention.
Figure 16:
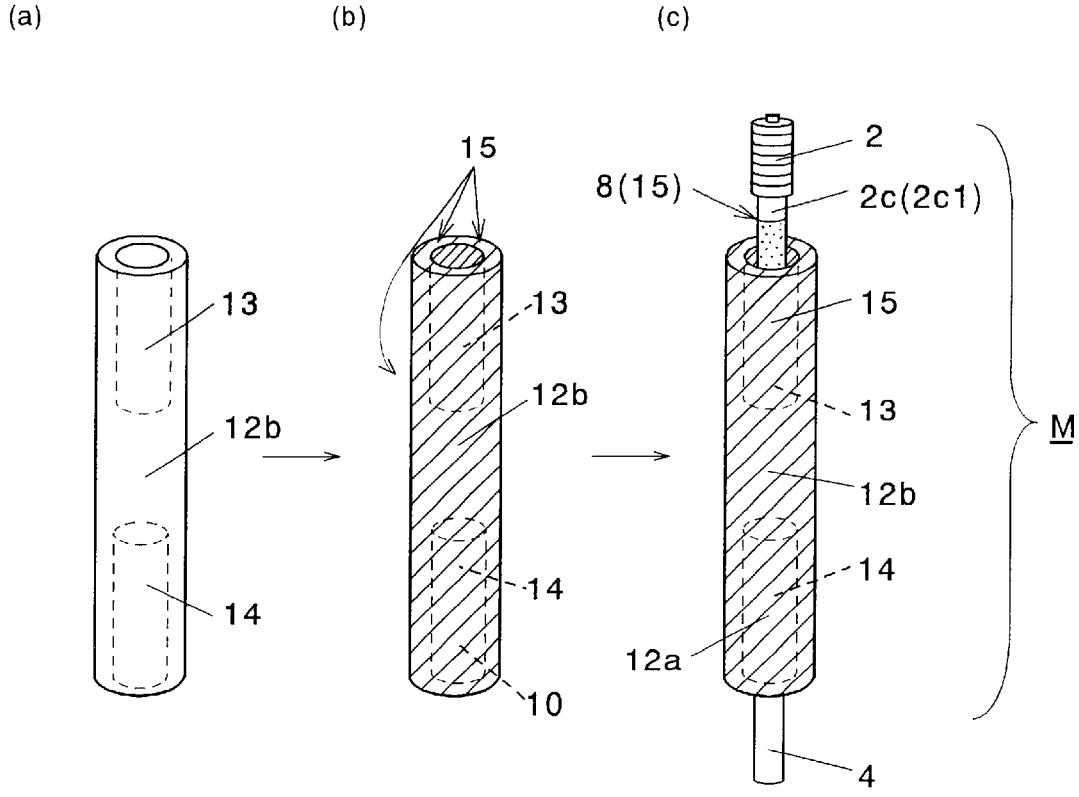
FIGS. 16(*a*) to 16(*c*) are schematic process diagrams for explaining a production process for an electrode mount employing a glass rod block in accordance with a modification of the third embodiment shown in FIGS. 14(*a*) to 14(*c*)

The present invention will hereinafter be described by way of the preferred embodiments. A mount M according to the invention may include (a)–(c):

(a) a light emitting element 2 such as a discharge electrode 2*a* or a filament 2*b* with in-lead rod 5(2*c*1), a molybdenum metal foil 3 and an outer lead rod 4 (FIGS. 1 to 4);

(b) a light emitting element 2, a molybdenum metal foil 3, an outer lead rod 4, and a glass bead 12*a* in which the molybdenum metal foil 3 is embedded (FIGS. 10(*a*) to 10(*c*) and FIGS. 12(*a*) to 12(*c*)); or (c) a light emitting element 2, a glass rod block 12*b* and an outer lead rod 4 (FIGS. 14(*a*) to 14(*c*) and FIGS. 16(*a*) to 16(*c*)).

Figure 2:
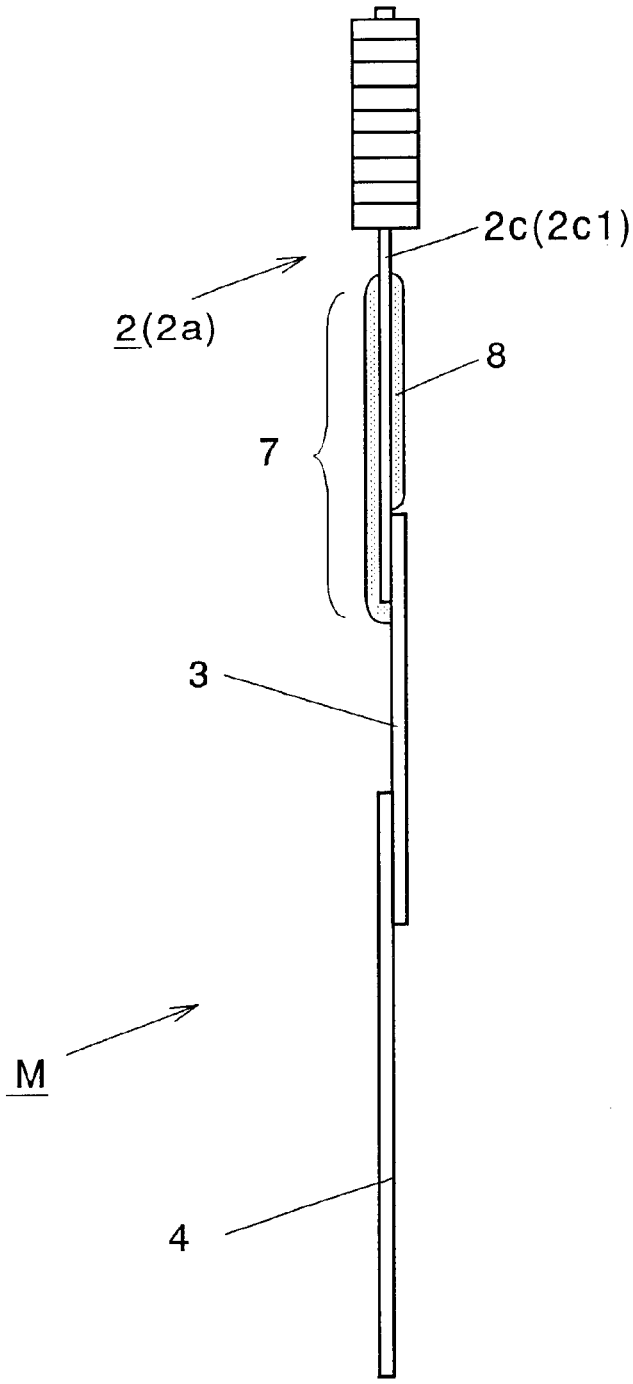
FIG. 2 is a side view of the mount of FIG. 1.
Figure 3:
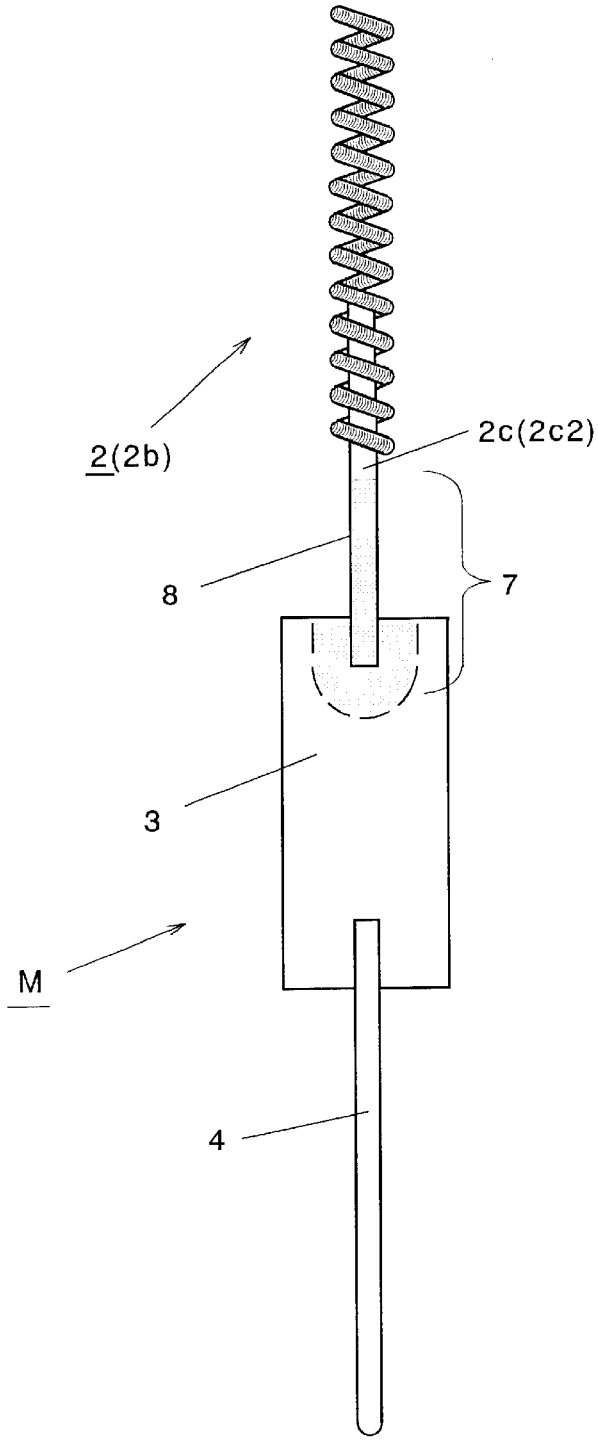
FIG. 3 is a front view of a filament mount according to the first embodiment of the present invention.
Figure 4:
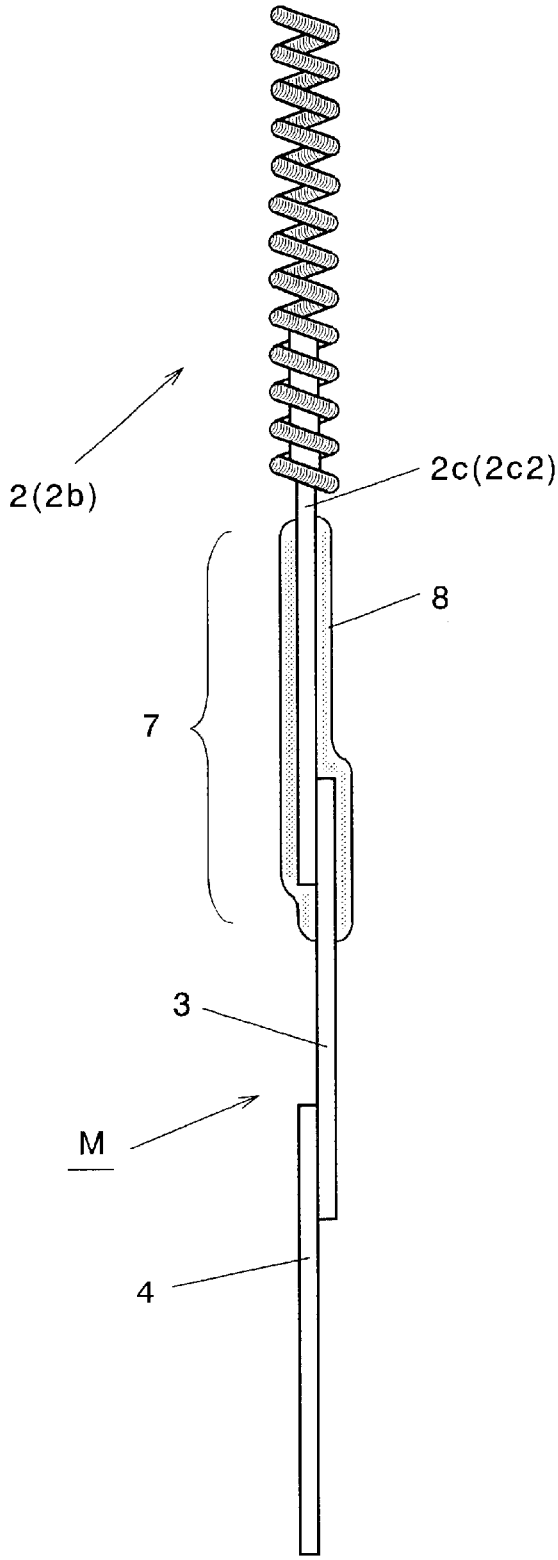
FIG. 4 is a side view of the mount of FIG. 3.

The mount M for use in the lamp A employs the discharge electrode 2*a* or the filament 2*b* as the light emitting element 2. FIGS. 1 and 2 illustrate an example of the mount M employing the discharge electrode 2*a,* while FIGS. 3 and 4 illustrate an example of the mount M employing the filament 2*b* (only a half of the mount M is shown).

FIGS. 10(*a*) to 10(*c*), FIGS. 12(*a*) to 12(*c*), FIGS. 14(*a*) to 14(*c*) and FIGS. 16(*a*) to 16(*c*) also illustrate examples of the mount M employing the discharge electrode 2*a*, but the filament 2*b* may be employed.

Features of the mount M according to the present invention are as follows:

(a) A separable layer 8 is provided on a surface of a portion 7 of the light emitting element 2 to be embedded in a seal portion (first embodiment).

(b) A glass bead 12*a* is employed, and a separable layer 8 is provided on a surface of a portion 7 of the light emitting element 2 which is surrounded by the glass bead 12*a* and out of the glass bead 12*a* (second embodiment).

(c) A glass rod block 12*b* is employed, and a separable layer 8 is provided on a surface of a portion 7 (third embodiment).

A common feature of these embodiments is the provision of the separable layer 8.

Since the provision of the separable layer 8 on the surface of the portion 7 to be embedded in the seal portion 6 is a main subject of the invention, a common explanation will be given to the cases where the discharge electrode 2*a* is employed as the light emitting element 2 and to the cases where the filament 2*b* is employed as the light emitting element 2 unless an additional explanation is required for distinction between these cases.

The separable layer 8 will first be described.

The separable layer 8 is composed, for example, of a metal thin film, a metallate or an oxide film. Where the separable layer 8 is comprised of a thin film of a metal, examples of the metal include Au, Mo and W. Formation of an Au film is achieved by gold plating or gold vapor deposition. Formation of a Mo film or a W film is achieved by using a metallate described below.

Where the separable layer 8 is composed of a metallate, examples of the metallate include tungstosilicate and molybdosilicate. The metallate functions as an effective separating agent at sealing. In addition, oxygen and crystallization water are removed from the metallate at heating in vacuo after the sealing (which will be described later), whereby only metal Mo or W remains on the surface of the portion 7. Therefore, no oxygen remains in the light emitting tube portion 1 of the product lamp A, so that the halogen cycle is not disturbed.

In this case, formation of the separable layer 8 of the metallate is achieved by ① dissolving a metallate of a high melting point metal such as tungstosilicate ($SiO_2 \cdot 12WO_3 \cdot 26H_2O$) or molybdosilicate in pure water, ② and applying the resulting solution onto the portion 7 of the light emitting element 2 by coating or dipping before the light emitting element 2 is welded to the metal foil 3, or coating the portion 7 of the light emitting element 2 with the solution after the welding (in the latter case, the solution inevitably adheres to a part of the metal foil 3 adjacent to the portion 7). After the coating or dipping, the solution is sufficiently dried.

Where the separable layer 8 is comprised of a film of a metal oxide, an example of the metal oxide is $SiO_2$. Formation of the separable layer 8 of the metal oxide film is achieved in substantially the same manner as described above by ① dispersing silica in pure water for preparation of colloidal silica, ② and applying the resulting silica dispersion onto the portion 7 of the light emitting element 2 by coating or dipping before the light emitting element 2 is welded to the metal foil 3, or coating the portion 7 of the light emitting element 2 with the dispersion after the welding (in the latter case, the dispersion inevitably adheres to a part of the metal foil 3 adjacent to the portion 7). After the coating or dipping, the dispersion is sufficiently dried.

The formation of the separable layer 8 is carried out in the following manner:

(1) The separable material is first applied onto at least the portion 7 of the light emitting element 2 for the formation of the separable layer 8, and then the resulting light emitting element 2 is welded to one end of the metal foil 3.

(2) Alternatively, one end of the light emitting element 2 is first welded to the one end of the metal foil 3, and then the separable material is applied on and around the portion 7 of the light emitting element 2 for the formation of the separable layer 8.

In the former case, the separable layer 8 is formed only on the light emitting element 2 as shown in FIGS. 1 and 2.

In the latter case, the separable layer 8 is generally spread around a weld portion of the metal foil 3 and the light emitting element 2 as shown in FIGS. 3 and 4. The portion 7 herein means the portion of the light emitting element 2 to be embedded in the seal portion 6 at the sealing. Therefore, the separable layer 8 is generally spread widely around the portion 7.

A lamp A is assembled by utilizing mounts M each having a separable layer 8 formed in the aforesaid manner in accordance with the first embodiment. An explanation will herein be given to an exemplary case where a lamp envelope 5 having a tip tube 10 is employed. The tipless method to be described later may of course be employed.

Figure 5:
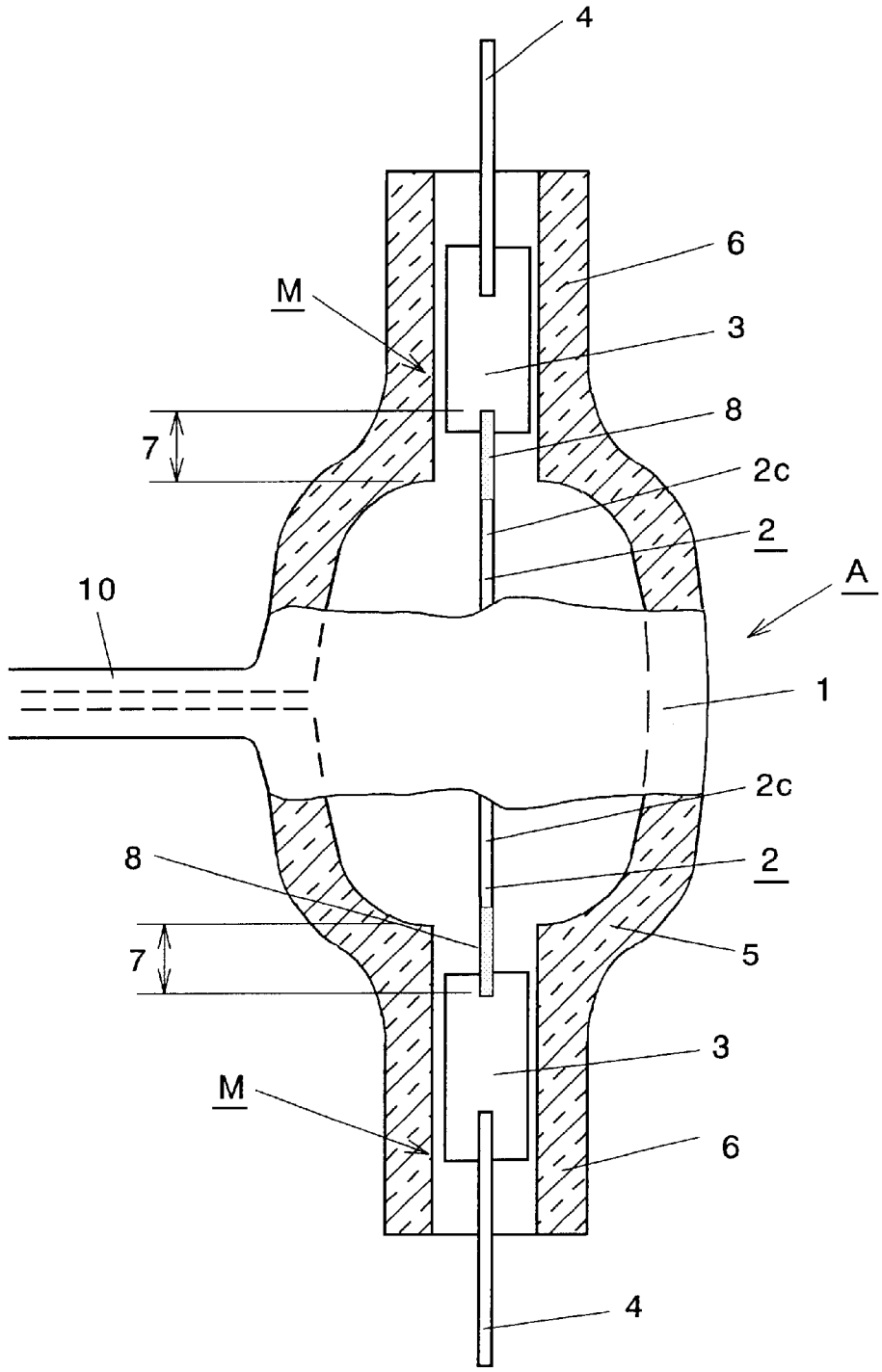
FIG. 5 is a sectional view for explaining a lamp production process utilizing the mount according to the first embodiment.
Figure 6:
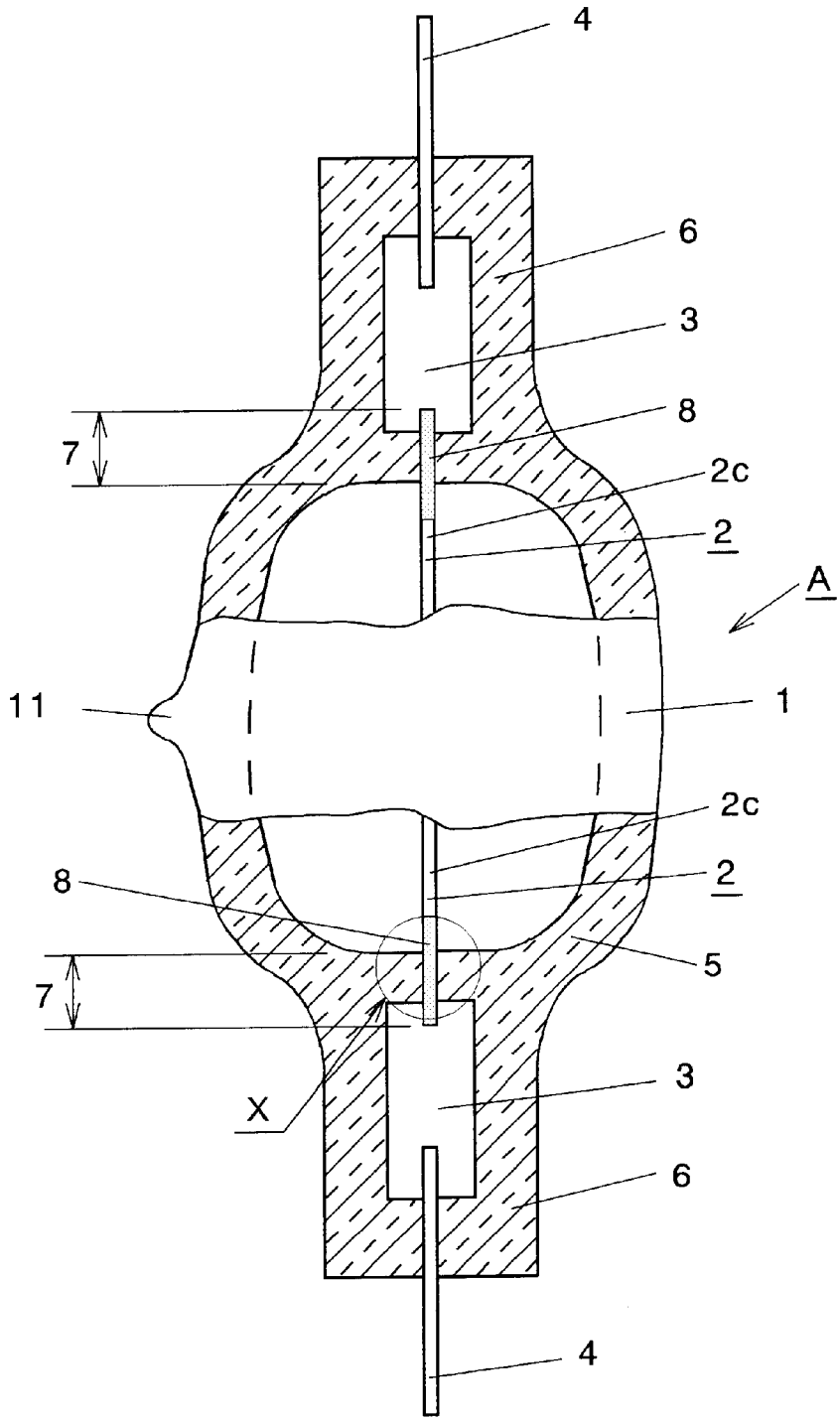
FIG. 6 is a sectional view of a lamp produced by utilizing the mount according to the first embodiment.

In the first embodiment, the mounts M are inserted to predetermined positions within the lamp envelope 5 provided with the tip tube 10 as shown in FIG. 5, and then the seal portions 6 of the lamp envelope 5 are externally heated to be softened for sealing in an inert atmosphere in a sealing device (not shown) in accordance with a predetermined procedure. The sealing may be achieved by fitting the mounts M respectively in the seal portions 6 provided at opposite ends of the lamp envelope 5 and simultaneously sealing the mounts M therein. Alternatively, the sealing may be achieved by fitting one of the mounts M in one of the seal portions 6 for sealing the one mount M therein, and then fitting the other mount M in the other seal portion 6 for sealing the other mount M therein. A pinch-sealing method or a shrink-sealing method may be employed for the sealing. In the pinch-sealing method, the seal portion 6 of the lamp envelope 5 located in association with the metal foil 3 is heated to be softened, and then the softened glass portion is held between dies (not shown) to be deformed into a plate shape. Thus, the metal foil 3 embedded in the seal portion 6 is brought into air-tight contact with the glass portion surrounding the metal foil 3. In the shrink-sealing method, the seal portion 6 of the lamp envelope 5 located in association with the metal foil 3 is heated to be softened, and then the softened glass portion is allowed to be uniformly shrunk. Thus, the metal foil 3 embedded in the seal portion is brought into air-tight contact with the glass portion surrounding the metal foil 3.

The sealing thus performed prevents direct contact between the light emitting element 2 and the seal portion 6 with the separable layer 8 interposed between the seal portion 6 and the portion 7 of the light emitting element 2.

After the completion of the sealing, the resulting lamp envelope 5 is taken out of the sealing device, and forcibly or naturally cooled (in some case, the lamp envelope 5 may be transferred to the subsequent step without cooling, but is cooled at any stage in the assembling process). At this time (cooling), the electrode rod 2*c*1 or in-lead rod 2*c*2 of the light emitting element 2 contracts to a greater extent than the glass seal portion 6 during the cooling after the sealing, so that a minute gap 9 occurs between the electrode rod 2*c*1 or in-lead rod 2*c*2 of the emitting element 2 and the seal portion 6. However, the separable layer 8 provided on the surface of the portion 7 of the light emitting element 2 adheres onto an interior surface of the seal portion 6 so as to be easily separated from the portion 7 (or from the interior surface of the seal portion 6). This prevents occurrence of minute cracks in the interior surface of the seal portion 6.

In turn, the resulting lamp envelope 5 with the tip tube 10 is put in a vacuum oven so as to be heated at a high temperature of 1150° C. in vacuo (or in a hydrogen reduction atmosphere in a hydrogen oven). The minute gap 9, which is present in the position where the separable layer 8 is provided, is also kept under vacuum. Where the separable layer 8 is composed of Au (a low melting point metal), for example, Au in the separable layer 8 is mostly evaporated, and the Au vapor is removed from a light emitting tube portion 1 through the tip tube 10. Accordingly, virtually no Au vapor remains in the light emitting tube portion 1. Even if the Au vapor slightly remains in the light emitting tube portion 1, the residual Au vapor will be recycled in the light emitting tube portion 1 by a halogen such as bromine, iodine and/or chlorine to be filled in the light emitting tube 1 at its lighting. Therefore, a blacking phenomenon will not occur due to the residual Au vapor.

Where the separable layer 8 is composed of the metallate such as tungstosilicate or molybdosilicate, the tungstosilicate or molybdosilicate layer 8 is present between the portion 7 of the light emitting element 2 and the seal portion 6 at the sealing, and the separation of the layer 8 occurs at the cooling for prevention of occurrence of minute cracks in the seal portion 6 as in the aforesaid case. Thereafter, the lamp envelope 5 is put in a vacuum oven and heated at a high temperature in vacuo (or in a hydrogen reduction atmosphere in a hydrogen oven) as in the aforesaid case. During the heating, crystallization water and oxygen resulting from decomposition of tungstosilicate or molybdosilicate are removed through the tip tube 10. As a result, W or Mo is left behind. W and Mo are high melting point metals which are the same as or of the same type as the material for the light emitting element 2, thereby serving for the halogen cycle. Therefore, W and Mo impose no problem even if they are left behind.

Where the separable layer 8 is comprised of an oxide film such as of $SiO_2$, the oxide film has the same function as the tungstosilicate or molybdosilicate layer. The $SiO_2$ film is present between the portion 7 of the light emitting element 2 and the seal portion 6 at the sealing, and the separation of the $SiO_2$ film occurs at the cooling for prevention of occurrence of minute cracks in the seal portion 6 as in the aforesaid cases. $SiO_2$ is the material for the lamp envelope 5 and, therefore, imposes no problem even if it is left behind.

Where the separable layer 8 is comprised of a metal film such as of Mo or W, the formation of the Mo or W film may be achieved by applying a tungstosilicate solution or a molybdosilicate solution on the predetermined portion 7 of the mount M, then drying the solution, and heating the resulting mount M in vacuo in a vacuum oven (or in a hydrogen oven for thermal reduction) thereby to reduce tungstosilicate or molybdosilicate into W or Mo. Where the separable layer 8 is formed from colloidal silica, the formation of the separable layer 8 may be achieved by applying colloidal silica on the predetermined portion 7 of the mount M by coating or dipping, then drying the colloidal silica, and heating the resulting mount M in vacuo in a vacuum oven for removal of crystallization water prior to the sealing. With this arrangement, the separation of the Mo, W or $SiO_2$ film occurs at the cooling after the sealing, thereby preventing occurrence of minute cracks in the seal portion 6. The lamp envelope 5 which has the seal portions 6 thus sealed without the occurrence of the minute cracks is subjected to the pressure resistance test with the use of the tip tube 10, so that only acceptable lamp envelopes 5 are used in the subsequent step.

Subsequently, the tip tube 10 is connected to an exhaust tube (not shown), and the inside of the light emitting tube 1 is cleaned by repeatedly filling and expelling an inert gas such as argon gas or $N_2$ gas into/from the light emitting tube 1. Then, one or some kinds of required gas and one or some required substances are filled in the light emitting tube 1. Finally, the tip tube 10 projecting from the light emitting tube 1 is sealed and cut, while the light emitting tube 1 is cooled by liquid nitrogen. A reference numeral 11 denotes a seal-cut portion of the tip tube 10.

Figure 7:
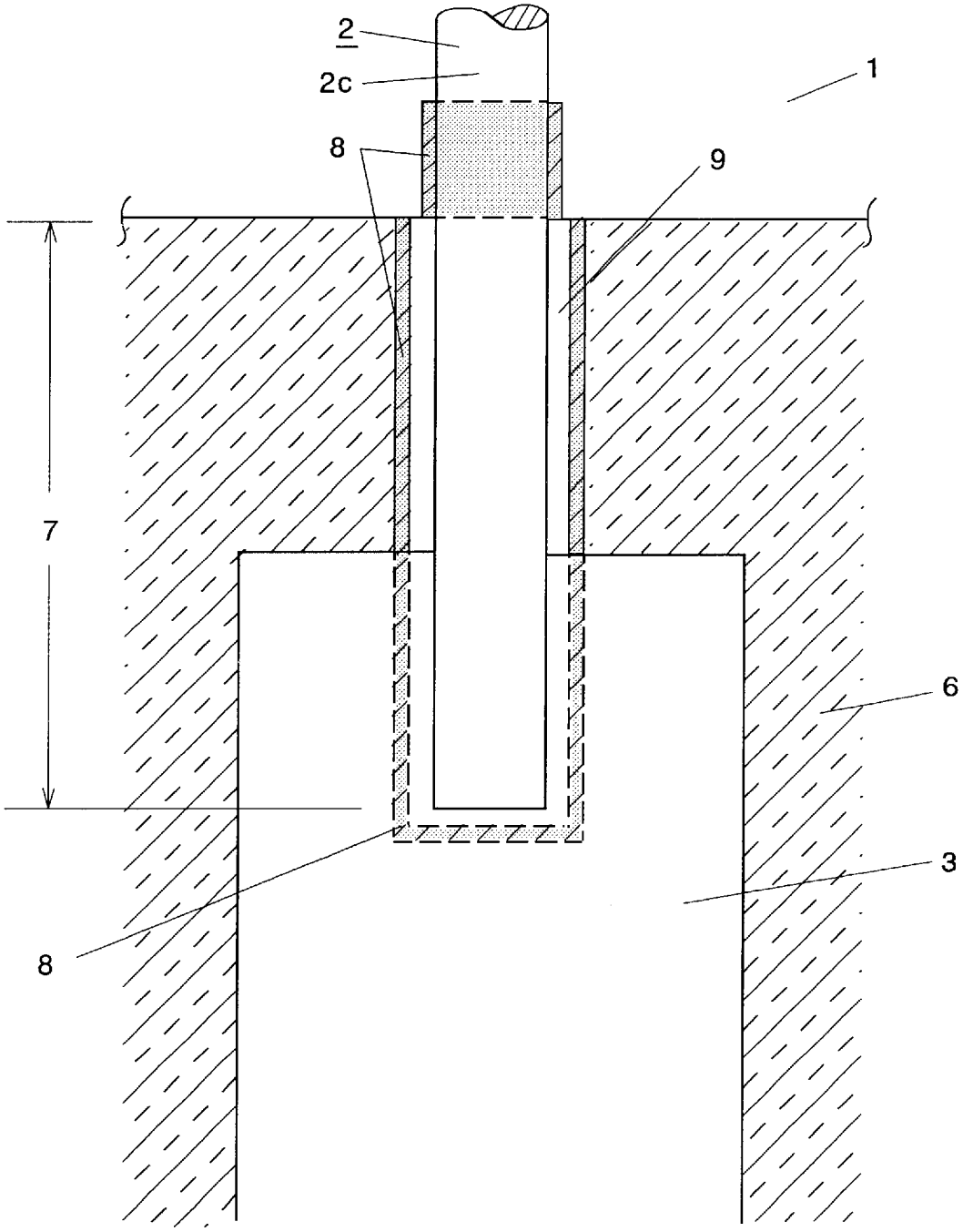
FIG. 7 is an enlarged sectional view of a part X of a seal portion in FIG. 6 for explaining a sealed state in accordance with the first embodiment.
Figure 8:
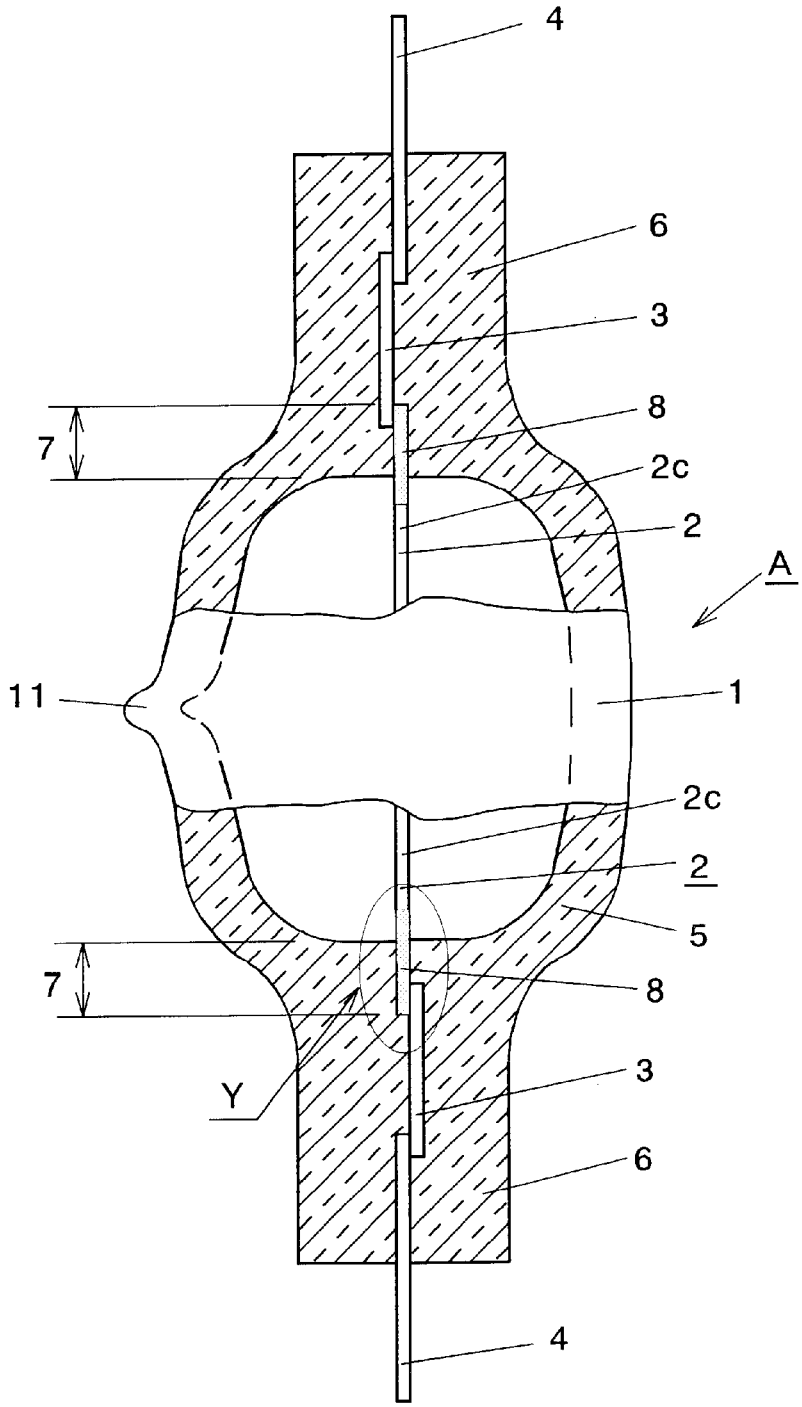
FIG. 8 is a sectional side view of the lamp of FIG. 6.
Figure 9:
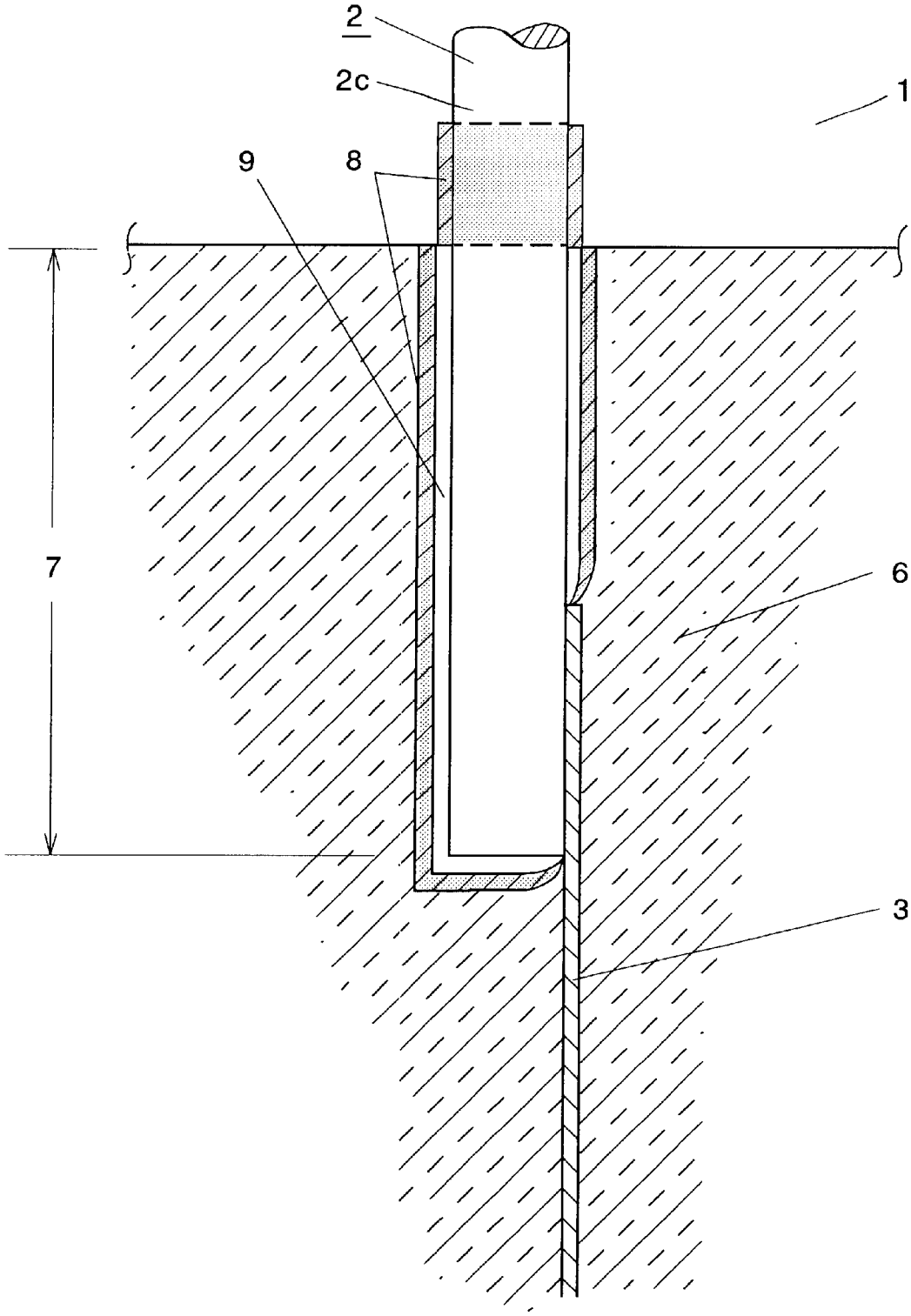
FIG. 9 is an enlarged sectional view of a part Y of the seal portion in FIG. 8 for explaining the sealed state in accordance with the first embodiment.

Thus, the lamp A can be provided which is free from minute cracks in the territory 7 of the seal portion 6 and has a remarkably improved pressure resistance (see FIG. 7). As described above, the lamp A is applicable as a discharge lamp such as a metal halide lamp which employs discharge electrodes 2*a* as the light emitting element 2, and a halogen lamp which employs a filament 2*b* as the light emitting element 2. The discharge lamp and the halogen lamp may be of a double-ended type or of a single-ended type.

Figure 21:
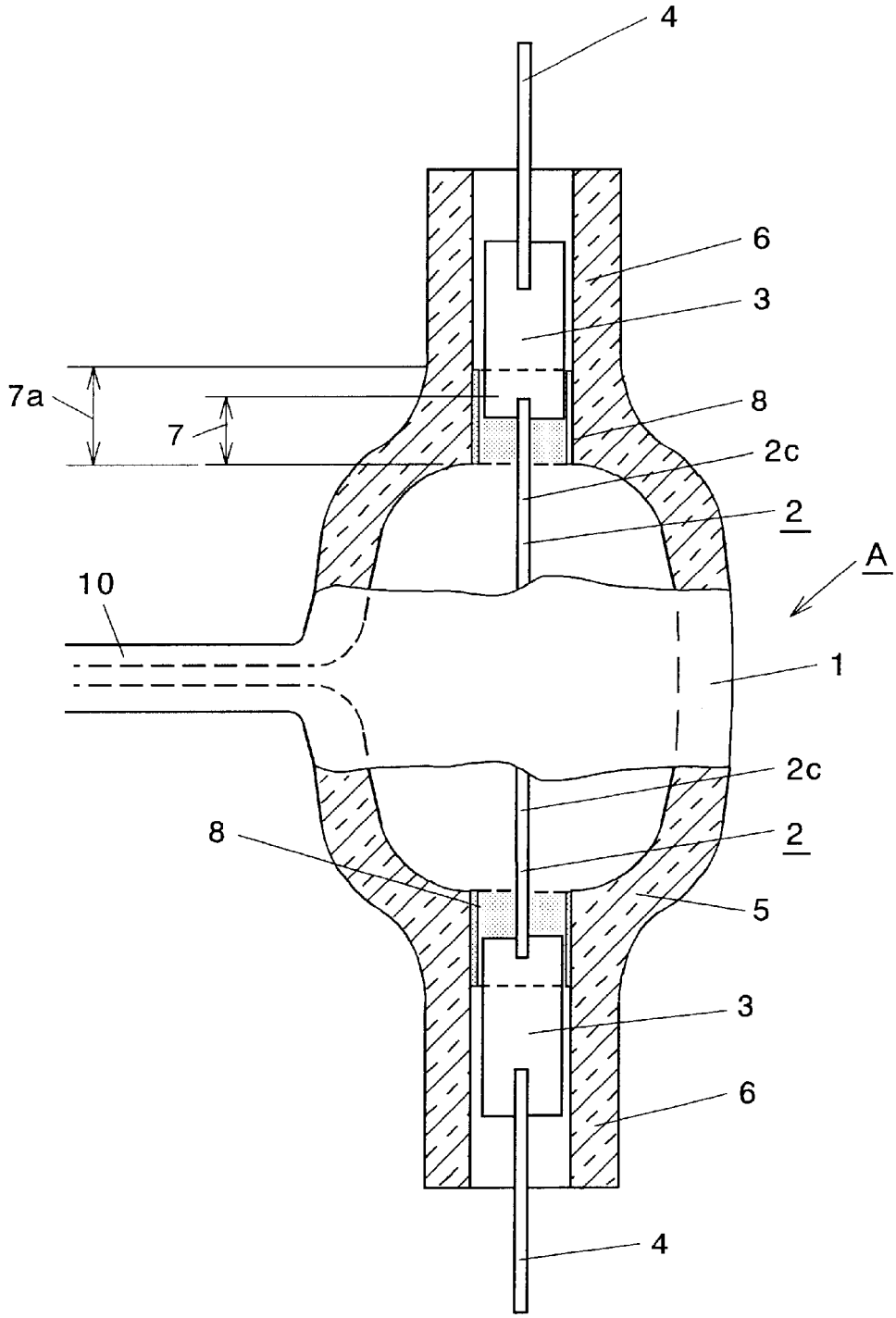
FIG. 21 is a sectional view illustrating a case where a separable layer is provided adjacent an end of a lamp envelope.

While the first embodiment of the invention is directed to the case where the separable layer 8 is provided on the portion 7 of the mount M, the separable layer 8 may be provided on the light emitting tube 1 as shown in FIG. 21 in accordance with a modification of the first embodiment. More specifically, the mount M is not formed with the separable layer 8 as in the prior art, but the separable layer 8 is provided on an interior surface of the seal portion 6 of the lamp envelope 5 located in association with the portion 7 of the mount M. The sealing is performed in the same manner as described above. At the cooling stage after the sealing, the same effect is provided for suppression of occurrence of minute cracks in the seal portion 6. The width of the separable layer 8 provided on the lamp envelope 5 is denoted by a reference character 7*a*.

FIGS. 10(*a*) to 10(*c*) illustrate a mount M according to the second embodiment, wherein a metal foil 3 of the mount M is preliminarily inserted in a glass tube 12*a*1 of a small wall thickness, which is used for indirect sealing of a seal portion 6. This mount will hereinafter be referred to as "beaded mount M".

The beaded mount M to be used in the second embodiment is subjected to a pressure resistance test by applying a high pressure in a state as shown in FIG. 10(*b*) from an opening of the glass tube 12*a*1. The glass tube 12*a*1 though having a thin wall, withstands a pressure of about 250 atm. The pressure resistance test is performed on the basis of a pressure to be exerted on the beaded mount M at illumination of the lamp A. Unacceptable beaded mounts M which have insufficient pressure resistance can be eliminated at this stage, so that the pressure resistance test improves the product yield.

After unnecessary portions of the glass tube 12*a*1 of the beaded mount M which has passed the pressure resistance test are cut off as shown in FIG. 10(*c*) (of course, a shorter glass tube 12*a*1 may be employed so that a in-lead rod 2*c* or a electrode rod 8 of the light emitting element 2 and an outer lead rod 4 are exposed to the outside at fusing of the glass tube 12*a*1), the glass bead 12*a* of the mount M in which the metal foil 3 is sealed is inserted to a predetermined position in one end portion of a lamp envelope 5 as shown in FIG.

Figure 22:
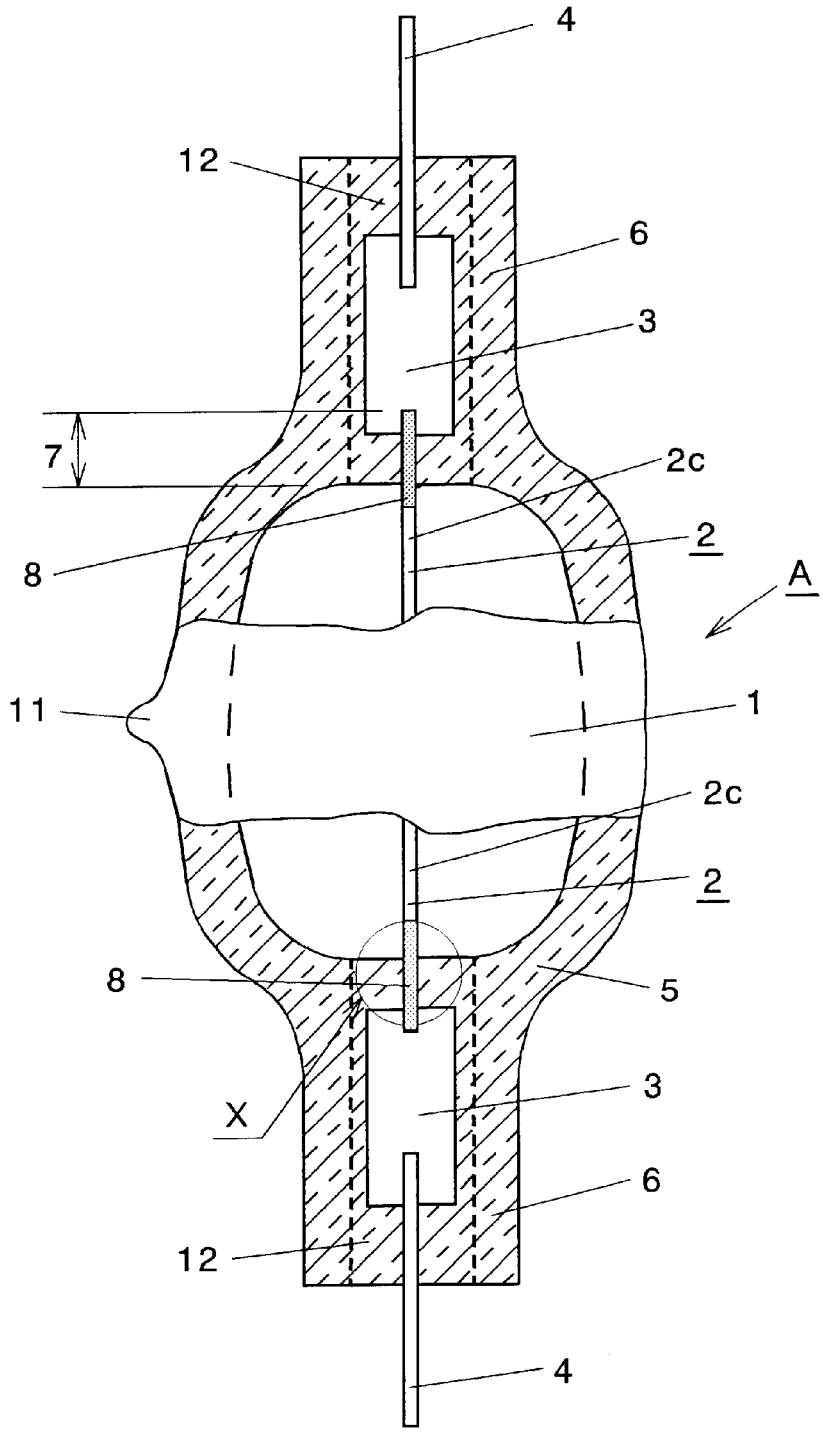
FIG. 22 is a partial sectional view of a lamp wherein a glass seal of a mount of the present invention is exposed into a bulb portion of a lamp envelope.
Figure 23:
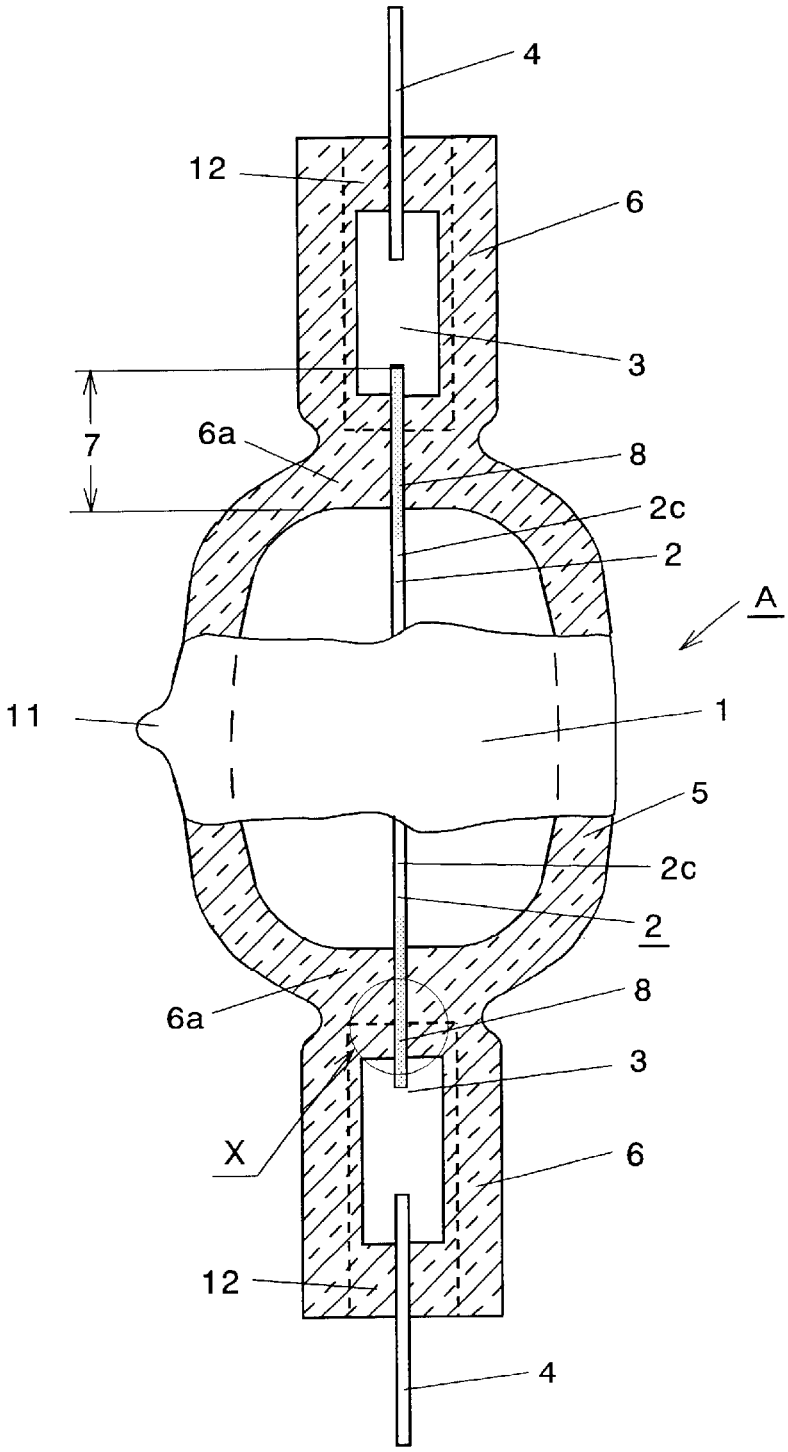
FIG. 23 is a partial sectional view of a lamp wherein a glass seal of a mount of the present invention is not exposed into a bulb portion of a lamp envelope but closed by a closure portion.

11(*a*), and sealed in the end portion by pinch-sealing or shrink-sealing. The resulting seal structure is illustrated in detail in FIG. 22.

The glass portion (glass bead) of the lamp A in which the metal foil 3 is embedded is denoted by a reference numeral 12. In this case, the glass bead portion 12 is sealed in the seal portion 6 of the lamp envelope 5, so that the glass-to-glass fusion-bonding can easily and perfectly be achieved unlike the metal-to-glass bonding. Since the glass bead portion 12 is exposed into the inside of a light emitting tube 1, a separable layer 8 is interposed between the electrode rod 2*c*1 or the in-lead rod 2*c*2 of the light emitting element 2 and the glass bead portion 12 partly defining the seal portion 6.

Since the glass bead portion 12 has a smaller thickness, the glass tube 12*a*1 in which the metal foil 3 is embedded is composed of a smaller amount of glass, which is subject to contraction or deformation when being heated for the shrink-sealing or the pinch-sealing. Therefore, the distortion and breakage of the metal foil 3 can be prevented which may otherwise occur due to flow of the glass.

Figure 11:
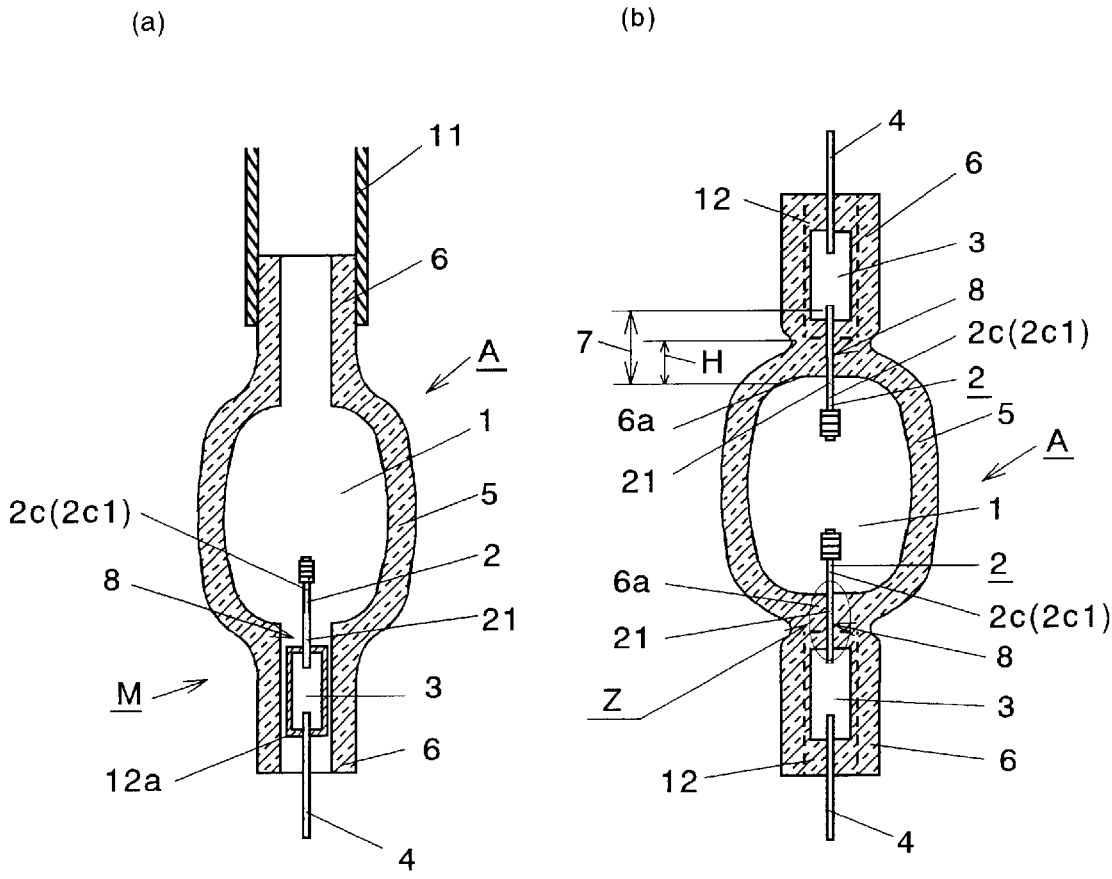
FIGS. 11(*a*) and 11(*b*) are schematic process diagrams for explaining a lamp production process employing the beaded electrode mount in accordance with the second embodiment of the present invention.
Figure 18:
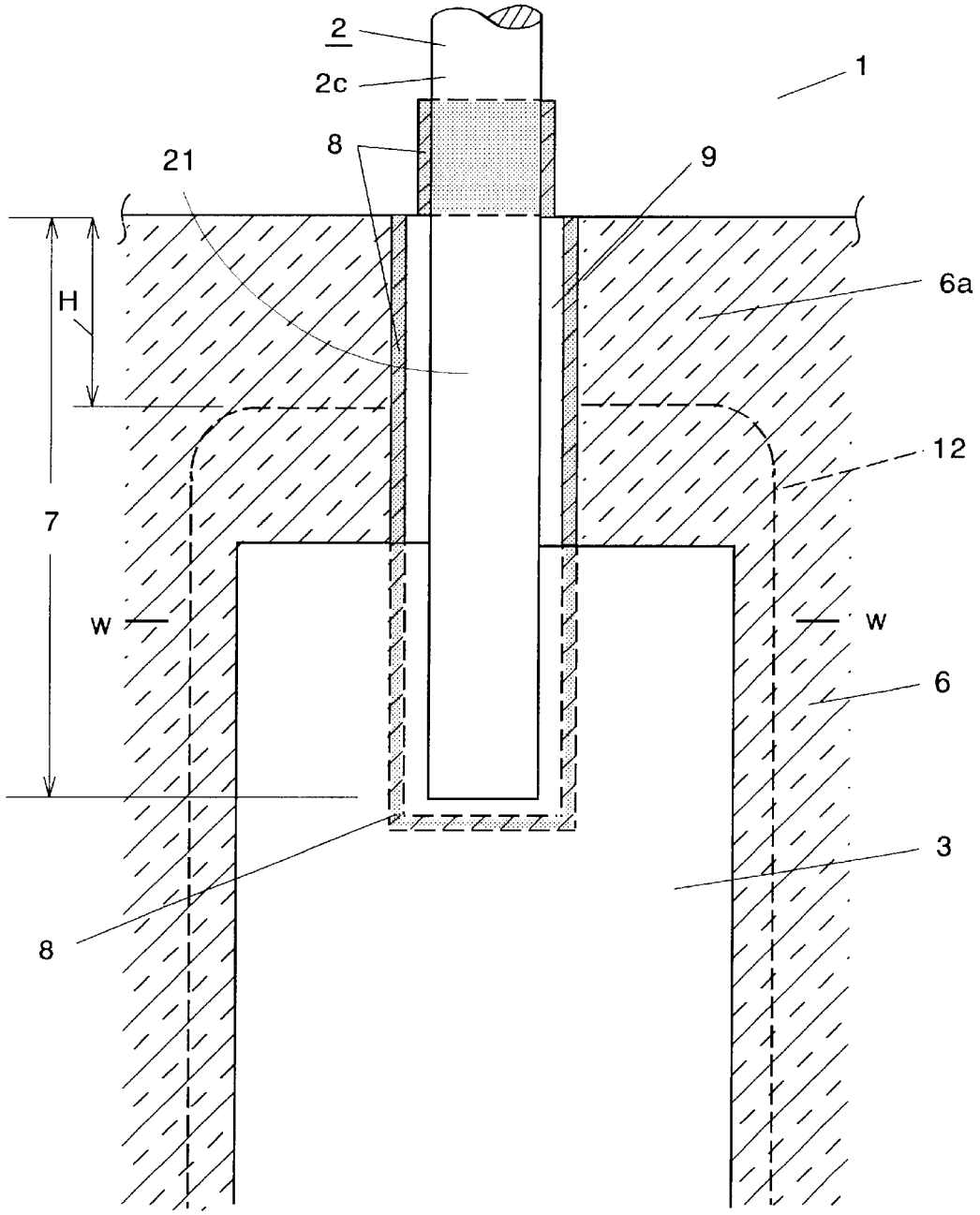
FIG. 18 is an enlarged sectional view of a portion Z in FIG. 11(*b*)
Figure 19:
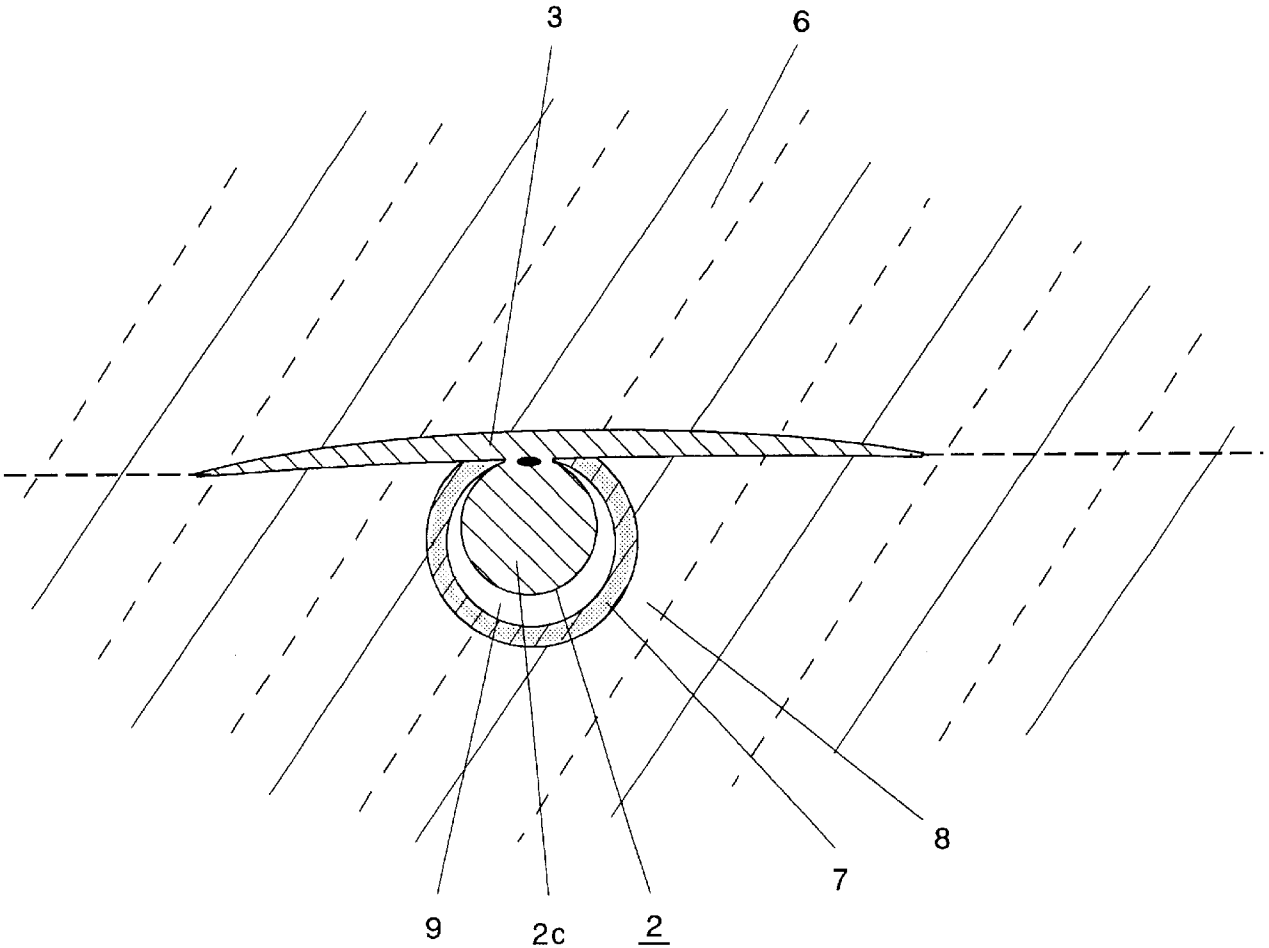
FIG. 19 is a sectional view taken along a line W—W in FIG. 18.

FIG. 11(*b*) and FIG. 18 illustrate a modification of the second embodiment, wherein a part of the seal portion 6 adjacent to the light emitting tube portion 1 is intensively heated at the indirect sealing shown in FIG. 11(*a*), so that the glass bead portion 12 is not exposed into the light emitting tube portion 1. This part is represented as a closure portion 6*a*, which has a width H. In this case, the separable layer 8 is interposed between the glass bead portion 12 partly defining the seal portion 6, the closure portion 6*a* and the electrode rod 2*c*1 or the in-lead rod 2*c*2 of the light emitting element 2. The presence of the closure portion 6*a* improves the pressure resistance of the lamp.

Although the explanation has been given to the case where the separable layer 8 is provided on the in-lead rod 2*c*2 or electrode rod 2*c*1, the separable layer 8 may of course be provided on the outer lead rod 4.

Where the lamp A according to the present invention is used as a high-pressure mercury lamp, the aforesaid tipless method is employed which utilizes no tip tube 10. Since the tipless method is a known technique, a minimum explanation will be given thereto for understanding of the invention. There will herein be described an exemplary case of a mount M where a glass bead 12*a* is employed and a discharge electrode is employed as a light emitting element 2. Of course, there may be a case where the glass bead 12*a* is not employed. Although the lamp A fabricated by the tipless sealing method cannot be subjected to a pressure resistance test after the fabrication thereof, there is no need to perform the pressure resistance test because the provision of the separable layer 8 prevents occurrence of minute cracks in the seal portion 6.

For assembling of the lamp A, as shown in FIG. 11(*a*), one opening end of the lamp envelope 5 is connected to an exhaust tube 11 in a sealing device (not shown), and the mount M is inserted into the other opening end of the lamp envelope 5. While an inert gas is supplied into the lamp envelope 5, the other end of the lamp envelope 5 in which the mount M is inserted is heated by a burner not shown. The heated portion, when sufficiently softened, is pinch-sealed or allowed to be shrunk for the shrink-sealing thereof. The glass bead 12*a* is integrated with the lamp envelope 5 to form the glass bead portion 12. The glass bead portion 12 may be exposed into the light emitting tube 1 but, in consideration of the pressure resistance, it is important to sufficiently heat the part of the seal portion 6 adjacent to the light emitting tube portion 1 so that the glass bead 12*a* is not exposed into the light emitting tube portion 1 as described above.

Thus, a proximal root portion 21 of the electrode rod 2*c*1 or the in-lead rod 2*c*2 projecting from the glass bead 12*a* is embedded in the closure portion 6*a* formed by heat-softening and shrinking the part of the seal potion 6, so that the glass bead portion 12 is prevented from being exposed into the light emitting tube portion 1. The closure portion 6*a* have a width H as measured from the end of the glass bead portion 12 embedded in the seal portion 6 to an interior surface of the light emitting tube portion 1. Thus, the sealing of the one end of the lamp envelope 5 is completed.

In this case, the glass bead 12*a* is sealed in the end portion of the lamp envelope 5, so that the glass-to-glass fusion-bonding can more easily be achieved unlike the bonding between the metal foil 3 and the glass seal portion, that is metal-glass bonding. In FIG. 11(*b*), the fusion-bonded portion of the glass bead 12*a* is indicated by broken lines, and a reference numeral 12 denotes a fusion seal portion.

After the sealing of the one end of the lamp envelope 5 is thus completed, the other end of the lamp envelope is sealed. Where the separable layer 8 is formed by the application of a metallate or colloidal silica, it is necessary to subject the layer to the vacuum heating process or the hydrogen reduction/heating process prior to the sealing. This is because oxygen and crystallization water should completely be removed from the metallate or colloidal silica prior to the sealing of the other end of the lamp envelope 5. Where the separable layer 8 is composed of Au, W or Mo, neither oxygen nor crystallization water is present therein and, hence, the sealing of the other end can subsequently be performed without performing the aforesaid process.

Where the separable layer 8 is formed by the application of the metallate or colloidal silica, the lamp envelope 5 is disconnected from the exhaust base 11, and then another mount M is inserted into the other end portion of the lamp envelope. The mount M is fixed in a predetermined position in the other end portion, for example, by a spring not shown. The lamp envelope 5 of this state is put in a vacuum oven and heated at a temperature of about 1150° C. in vacuo (or the lamp envelope is pretreated in a hydrogen oven for removal of $O_2$, and then heated in the vacuum oven for removal of crystallization water). Thus, the removal of $O_2$ and crystallization water from the metallate or the removal of crystallization water from the silica can be achieved, so that W, Mo or $SiO_2$ remains in the separable layer 8.

Subsequently, the other end of the lamp envelope 5 is connected to the exhaust tube 11 in the sealing device for cleaning the light emitting tube portion 1 of the lamp envelope 5 by evacuation of the lamp envelope 5 and supply of an inert gas into the light emitting tube portion 1 of the lamp envelope 5, and then required substances (for example, a metal halide and Hg) which may be supplied into the light emitting tube portion 1 before the lamp envelope 5 is connected to the exhaust tube 11 and some kinds of required gas are supplied into the light emitting tube portion 1. Finally, a part of the end portion of the lamp envelope 5 located in association with the glass bead 12*a* is externally heated, and pinch-sealed or shrink-sealed in the aforesaid manner. At this time, a closure portion 6*a* is formed, so that a root portion 21 of a in-lead rod 2*c*2 or an electrode rod 2*c*1 of the light emitting element 2 at the second seal portion is embedded in the closure portion 6*a*. The closure portions 6*a* formed at the opposite portions have the same width H.

The separable layer 8 is interposed between the root portion 21 and the closure portion 6*a*, the glass bead portion 12, thereby preventing the root portion 21 of the electrode rod 2*c*1 or the in-lead rod 2*c*2 of the light emitting element 2 from being brought into direct contact with the closure portion 6*a* of the seal portion 6 and the glass bead portion 12.

After the completion of the sealing of the other end of the lamp envelope 5, the lamp A is taken out of the sealing device, and forcibly or naturally cooled. The electrode rod 2*c*1 or the in-lead rod 2*c*2 of the light emitting elements 2 contracts to a greater extent than the seal portion 6 of the envelope 5 and the glass bead portion 12 during the cooling after the sealing, so that a minute gap 9 occurs therebetween. However, the separable layer 8 of Au, W, Mo or $SiO_2$ provided on the surface of the portion 7 of the electrode rod 2*c*1 or the in-lead rod 2*c*2 of the light emitting element 2 adheres onto an interior surface of the seal portion 6 so as to be easily separated from the portion 7. This prevents occurrence of minute cracks in the interior surfaces of the closure portion 6*a* of the seal portion 6 and the glass bead portion 12.

Au, W or Mo constituting the separable layer 8 is recycled in the light emitting tube portion 1 by a halogen such as bromine, iodine and/or chlorine filled in the light emitting tube portion 1 and, therefore, does not cause a blacking phenomenon. Further, $SiO_2$ which is the material for the lamp envelope 5 imposes no problem on the lamp A.

The explanation has been given to the case where the separable layer 8 is provided on the mount M, but the invention is not limited thereto. As shown in FIGS. 12(*a*) to 12(*c*) and FIGS. 13(*a*) and 13(*b*), a separable layer 8 may be provided in a predetermined position of the glass tube 12*a*1 and the lamp envelope 5 (in association with the portion 7 of the light emitting element 2). In this case, the lamp can be fabricated in substantially the same manner as described above.

Figure 15:
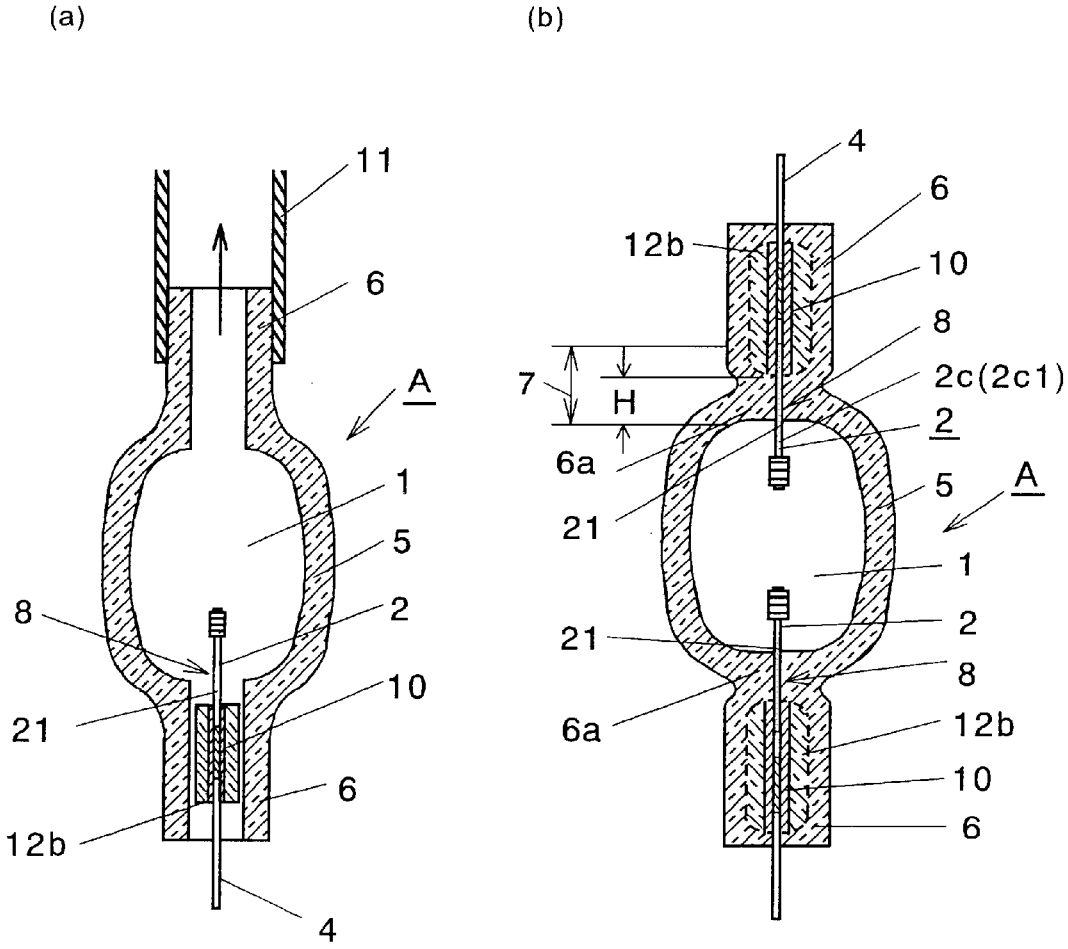
FIGS. 15(*a*) and 15(*b*) are schematic process diagrams for explaining a lamp production process employing the electrode mount with the glass rod block in accordance with the third embodiment.

FIGS. 14(*a*) through 17(*b*) illustrate mounts M according to the third embodiment, wherein a glass rod block 12*b* is employed instead of the metal foil 3. The glass rod block 12*b* shown in FIGS. 14(*a*) to 14(*c*) and FIGS. 15(*a*) and 15(*b*) includes a glass tube 12*b*1 and a glass rod 12*b*2 fusion-bonded within the glass tube 12*b*1. The glass tube 12*b*1 has a wall thickness sufficiently smaller than the wall thickness of a lamp envelope 5, an outer diameter slightly smaller than the inner diameter of an end portion of the lamp envelope 5, and an inner diameter slightly larger than the diameters of insertion portions 2*c* of a light emitting element 2 and an outer lead rod 4 which are to be attached thereto in a later step. A metal thin film 10 is provided on an interior surface (bore surface) of the glass tube 12*b*1 by vapor deposition or by utilizing the aforesaid metallate. The metal thin film 10 is composed of Mo or W.

The metal thin film 10 may entirely cover the inner surface of the glass tube 12*b*1 or linearly be formed on the inner surface. The metal thin film 10 has a thickness of about 20 $\mu$m.

More specifically, a solution containing tungstosilicate or molybdosilicate dissolved in pure water is applied on the inner circumferential surface of the glass tube 12*b*1, and dried. Then, the resulting glass tube is heated in a vacuum oven in the aforesaid manner for removal of oxygen and crystallization water (or pretreated in a hydrogen oven for removal of oxygen and put in a vacuum oven for removal of crystallization water). Thus, the thin film 10 of metal W or metal Mo is formed on the inner circumferential surface of the glass tube 12*b*1.

The solid glass rod 12*b*2 having an outer diameter substantially the same as the inner diameter of the glass tube 12*b*1 is inserted in the glass tube 12*b*1 having the metal thin film 10 formed in the inner circumferential surface thereof, and then the resulting glass tube 12*b*1 is heated so that the outer circumferential surface of the solid glass rod 12*b*2 is air-tightly bonded to the inner circumferential surface of the glass tube 12*b*1 with the intervention of the metal thin film 10. Thus, the glass rod block 12*b* is provided which has bores 14 and 13 respectively formed at opposite ends thereof for receiving the rod portion 2*c* of the light emitting element 2 and for receiving the outer lead rod. A pressure resistance test is performed at this stage to check for the air-tight contact between the solid glass rod 12*b*2 and the glass tube 12*b*1.

As shown in FIG. 14(*c*), the rod portion 2*c* of the light emitting element 2 and the outer lead rod 4 are respectively inserted in the bores 13 and 14 formed at the opposite ends of the glass rod block 12*b*, and then fixed in the bores 13 and 14 by heat-shrinking the glass rod block 12*b* or heat-pressing the glass rod block 12*b* from the outer side thereof Since the inner diameter of the bore 14 is slightly greater than the diameter of the insertion portion 2*c* of the light emitting element 2 as described above, the light emitting element 2 can perfectly or substantially be centered with the glass rod block 12*b*. The fixing is achieved by the aforesaid shrink-sealing method or the pinch-sealing method.

The shrink-sealing or pinch-sealing of the glass rod block 12*b* is achieved in the same manner as described above by the tipless method. Since the deformation of the seal portion 6 is negligible, the light emitting element 2 can be centered with the glass rod block 12*b* with a high centering accuracy. Therefore, the assembling accuracy of the light emitting element 2 with respect to the glass rod block 12*b* is drastically improved as compared with the prior art. Through the shrink-sealing or the pinch-sealing, the light emitting element 2 and the outer lead rod 4 are respectively brought into electrical contact with portions of the metal thin film 10 present in the bores 13 and 14, so that electrical connection between the light emitting element 2 and the outer lead rod 4 is established via the metal thin film 10. As in the modification of the second embodiment, a closure portion 6*a* is formed in which a root portion 21 of the light emitting element 2 is enclosed.

Figure 17:
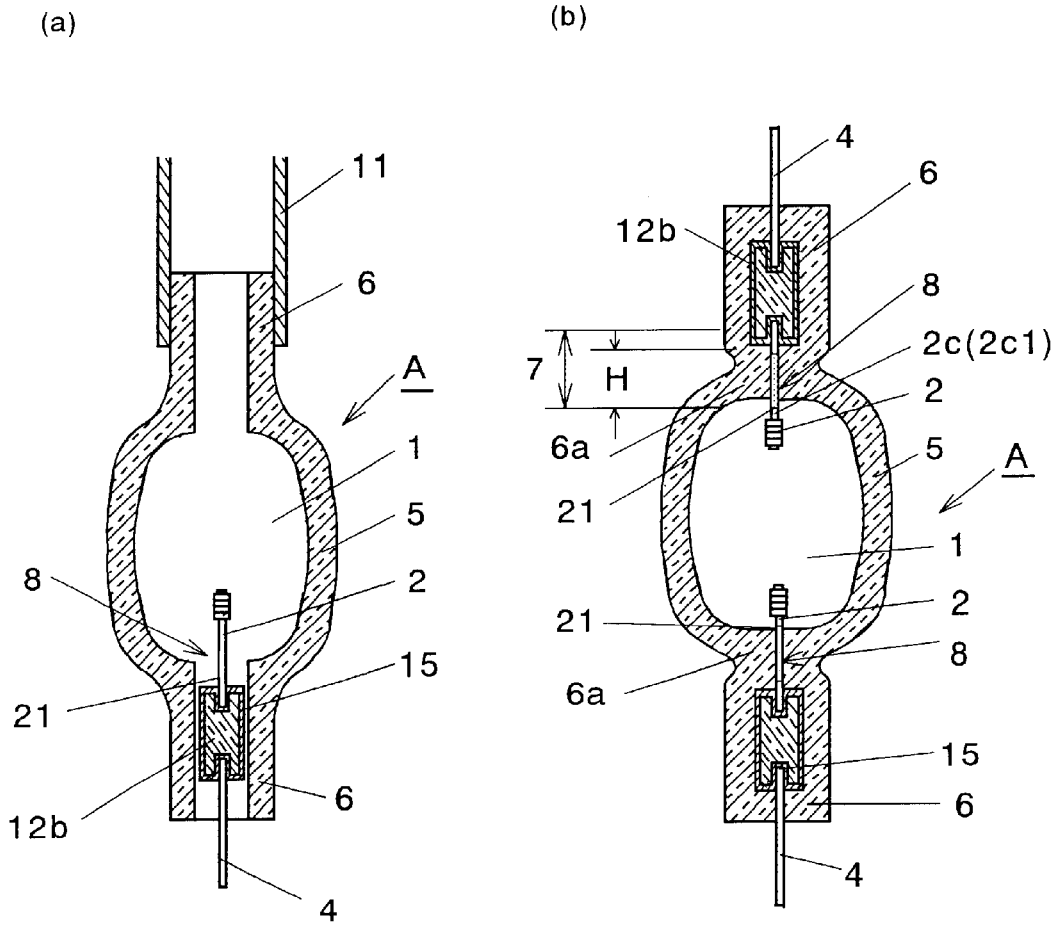
FIGS. 17(*a*) and 17(*b*) are schematic process diagrams for explaining a lamp production process employing the electrode mount with the glass rod block in accordance with the modification of the third embodiment shown in FIGS. 14(*a*) to 14(*c*)

FIGS. 16(*a*) to 16(*c*) and FIGS. 17(*a*) and 17(*b*) illustrate a sealing method according to a modification of the third embodiment. In these figures, a reference character 12*b* denotes a glass rod block which has an outer diameter slightly smaller than the inner diameter of an end portion of a lamp envelope 5. As shown in FIG. 16(*a*), the glass rod block 12*b* has a bore 13 provided on one end thereof for receiving a rod portion 2*c* of a light emitting element 2, and a bore 14 provided on the other end thereof for receiving an outer lead rod 4. The bores 13, 14 each have a depth of about 5 mm, and are not communicate with each other. The bores 13 and 14 have inner diameters slightly greater than the outer diameters of the light emitting element 2 and the outer lead rod 4. The glass rod block 12*b* is produced, for example, by fusion-bonding a short solid glass rod within a glass tube.

In turn, a metal thin film 15 is formed on the entire surface of the glass rod block 12*b* including the bores 13, 14, as shown in FIG. 16(*b*), by vapor deposition or by utilizing the aforesaid metallate. Alternatively, a linear metal thin film is formed on the surface of the glass rod block as extending from the bore for the light emitting element to the bore for the outer lead rod by the same method (not illustrated).

Subsequently, the rod portion 2*c* of the light emitting element 2 and the outer lead rod 4 are fixed in the bores 13 and 14, respectively, in the aforesaid manner as shown in FIG. 16(*c*). Thus, the electrical connection between the light emitting element 2 and the outer lead rod 4 is established by the metal thin film 15 in the same manner as described above. A metal thin film 15 is also formed on a part of the root portion 21 of the rod portion 2*c* of the light emitting element 2 exposed from the bore 13, and functions as a separable layer 8. The separable layer 8 is formed, preliminarily or after the assembling, on the exposed portion (the root portion 21 of the rod portion 2*c* of the light emitting element 2) in the aforesaid manner.

In turn, the glass rod block 12*b* fitted with the light emitting element 2 and the outer lead rod 4 is inserted to a predetermined position in one end portion of the lamp envelope 5 as shown in FIG. 17(*a*), and then pinch-sealed or shrink-sealed in the one end portion. Thus, the tipless sealing process is completed as shown in FIG. 17(*b*).

In this embodiment, the metal thin film 15 has the same function as the metal foil 3 as in the first and second embodiments. At the sealing, the part of the light emitting element 2 exposed from the bore 13 (formed with the metal thin film 15) is embedded in a closure portion 6*a,* and the metal thin film 15 on the exposed part of the light emitting element 2 functions as the separable layer 8, thereby preventing offset of the light emitting element 2 otherwise occurring due to flow of the glass at the sealing of the end of the lamp envelope 5, electrical connection failure otherwise occurring due to breakage of the metal thin film 15, and leakage otherwise occurring due to defective sealing.

An experiment was performed in the following manner to confirm the effect of the provision of the separable layer 8 in the present invention.

A 8,000-hour continuous illumination test was performed on lamps each having the separable layer 8 according to the present invention and comparative lamps not having the separable layer 8. None of the lamps according to the invention ruptured, while 20% of the comparative lamps ruptured. Thus, it was confirmed that the provision of the separable layer 8 is effective for improvement of the service life of the lamps.

An experiment was performed in the following manner to confirm the effect of the provision of the closure portion 6*a*.

Figure 13:
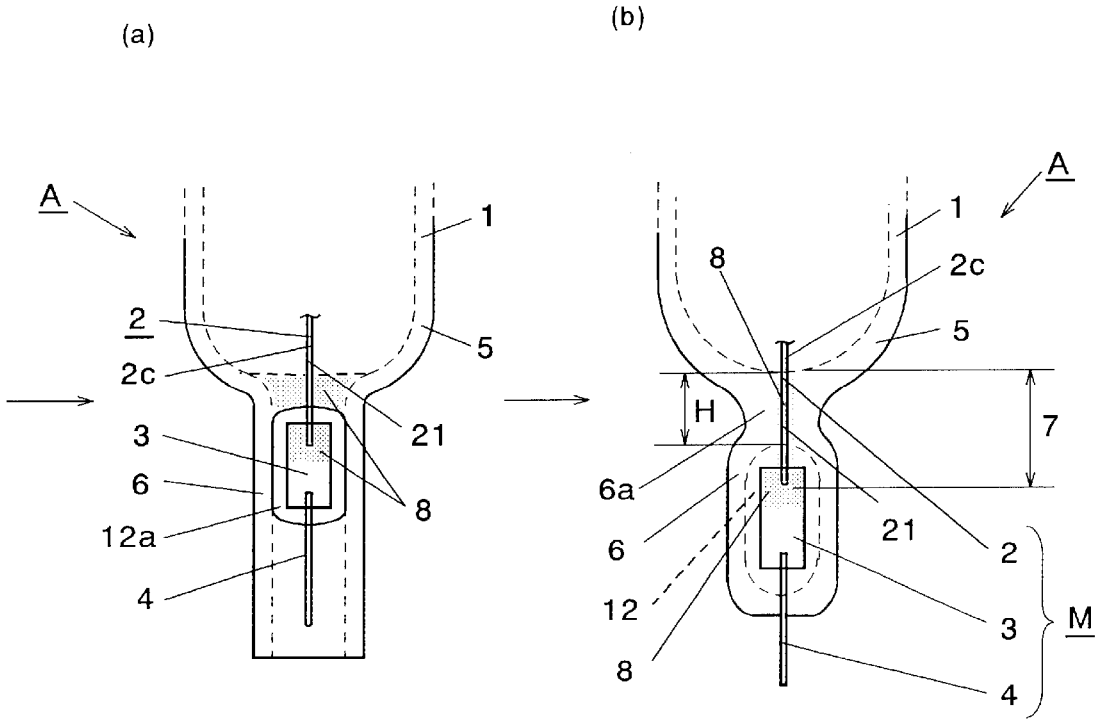
FIGS. 13(*a*) and 13(*b*) are schematic process diagrams for explaining a lamp production process employing the beaded electrode mount shown in FIGS. 12(*a*) to 12(*c*) in accordance to the modification the second embodiment.

Lamps A each having a construction as shown in FIG. 13(*b*) were fabricated with closure portions 6*a* thereof having different widths H, and the withstand pressures of the lamps were determined. The lamps having 0-mm, 1-mm, 2-mm, 3-mm and 4-mm wide closure portions 6*a* ruptured at 150 atm, 190 atm, 210 atm, 240 atm and 270 atm, respectively, due to cracking of the seal portion 6. This suggests that the pressure resistance is improved as the width H of the closure portion 6*a* increases.

Figure 20:
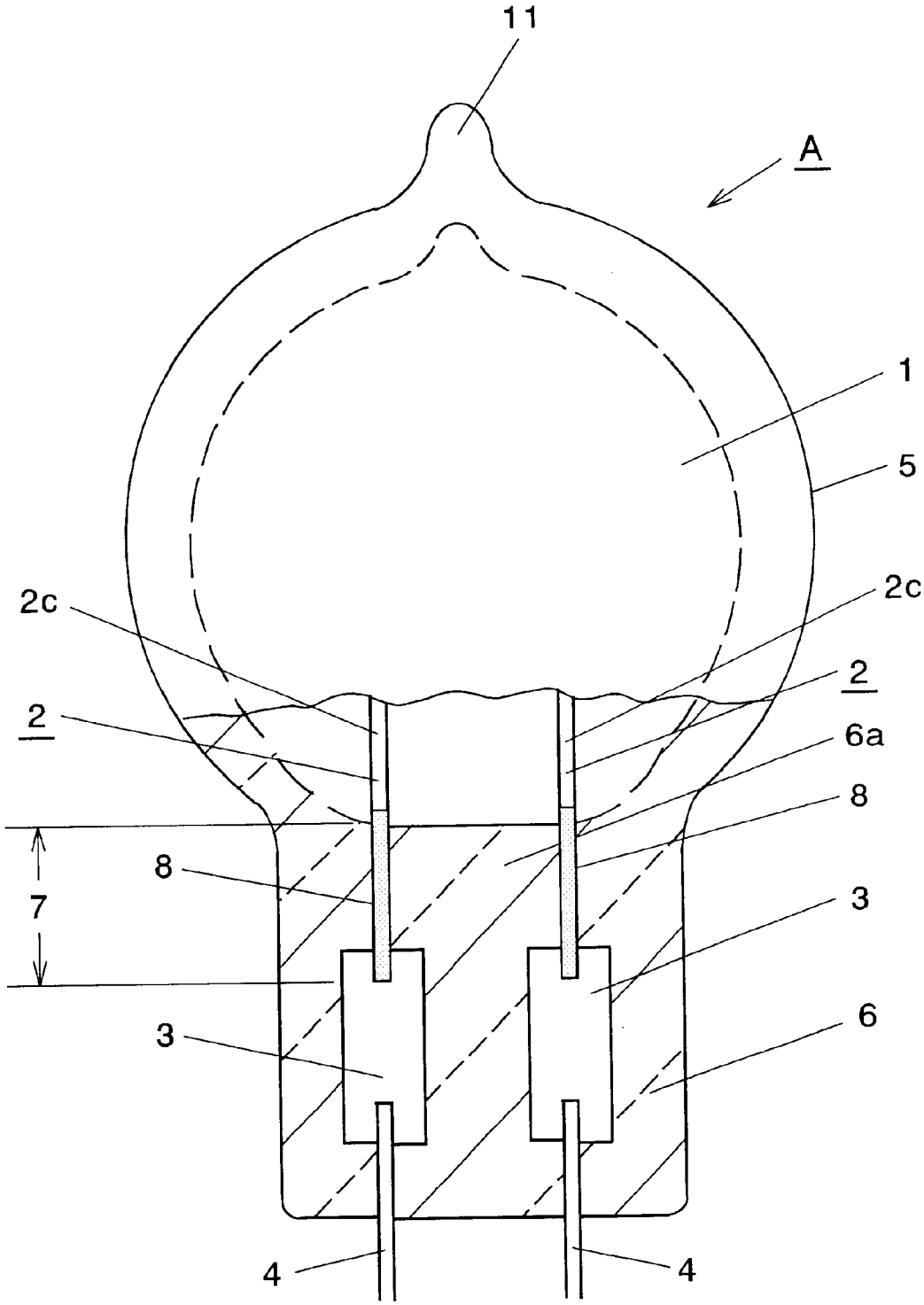
FIG. 20 is a partial sectional view of a lamp of single-ended type employing a mount according to the present invention.

FIG. 20 illustrates a single-ended lamp A which employs the mounts M each having the separable layer 8 in accordance with the present invention. The lamp has substantially the same seal structure as described above and, therefore, no explanation will herein be given thereto.

As described above, the provision of the separable layer 8 on required portions 7 of the mount M or the lamp envelope 5 prevents occurrence of minute cracks in the interior surface of the closure portion 6*a* of the seal portion 6, thereby extending the service life of the lamp.

The lamp is sealed by employing the mount which has the metal foil embedded in the glass bead. This permits the glass-to-glass sealing rather than the conventional sealing between the metal foil and the glass components, allowing for easier fusion-bonding of the glass components. In addition, the metal foil is preliminarily embedded in the glass seal for protection thereof, so that the metal foil is not directly influenced by the flow of the glass at the sealing. Therefore, the metal foil is free from breakage and distortion.

At the sealing, the part of the seal portion adjacent to the light emitting tube is sufficiently heated to form the closure portion, whereby the glass seal is completely embedded in the seal portion. Accordingly, the weakest portion of the glass seal is enclosed in the seal portion thereby to be strengthened. Therefore, the light emitting tube is capable of withstanding an ultra-high pressure.

What is claimed is:

1. A mount for use in a lamp having a light emitting tube portion and seal portions, the mount comprising:

a metal foil to be embedded in the seal portion of the lamp;

a light emitting element attached to one of the opposite ends of the metal foil and adapted to be introduced in the light emitting tube portion; and an outer lead rod attached to the other end of the metal foil and adapted to be led out of the seal portion, wherein a separable layer configured to separate from a surface portion of the light emitting element is provided on the surface of the portion of the light emitting element to be embedded in the seal portion.

2. A mount for use in a lamp having a light emitting tube portion and seal portions, the mount comprising:

a metal foil embedded in a glass bead to be embedded in the seal portion of the lamp;

a light emitting element attached to one of opposite ends of the metal foil and adapted to be introduced in the light emitting tube; and an outer lead rod attached to the other end of the metal foil and adapted to be led out of the seal portion, wherein a separable layer configured to separate from a surface portion of the light emitting element is provided on the surface of the portion of the light emitting element to be embedded in the seal portion.

3. A mount for use in a lamp having a light emitting tube portion and seal portions, the mount comprising:

a glass rod block to be embedded in the seal portion of the lamp;

a light emitting element fitted in a bore formed in one of opposite ends of the glass rod block and adapted to be introduced in the light emitting tube portion;

an outer lead rod attached to the other end of the glass rod block and adapted to be led out of the seal portion; and a metal thin film provided on a surface of the glass rod block for electrical connection between the light emitting element and the outer lead rod, wherein a separable layer configured to separate from a surface portion of the light emitting element is provided on the surface of the portion of the light emitting element to be embedded in the seal portion.

4. A mount as set forth in any of claims 1 to 3, wherein the separable layer is a metal thin film.

5. A mount as set forth in any of claims 1 to 3, wherein the separable layer is composed of a metallate.

6. A mount as set forth in claim 5, wherein the metallate is tungstosilicate.

7. A mount as set forth in claim 5, wherein the metallate is molybdosilicate.

8. A mount as set forth in any of claims 1 to 3, wherein the separable layer is an oxide film.

9. A mount as set forth in claim 8, wherein the oxide film is composed of $SiO_2$.

10. A mount as set forth in any of claims 1 to 3, wherein the light emitting element is a discharge electrode.

11. A mount as set forth in any of claims 1 to 3, wherein the light emitting element is a filament.

12. A seal structure of a lamp including:

a lamp envelope having a light emitting tube portion and seal portions;

a metal foil embedded in the seal portion of the lamp envelope;

a light emitting element attached to one of opposite ends of the metal foil and disposed in the light emitting tube; and an outer lead rod attached to the other end of the metal foil and led out of the seal portion, the seal structure comprising a separable layer configured to separate from a surface portion of the light emitting element interposed between the seal portion and a portion of the light emitting element embedded in the seal portion.

13. A seal structure of a lamp including:

a lamp envelope having a light emitting tube portion and a seal portion;

a metal foil embedded in a glass bead, which is fusion-bonded integrally with the seal portion of the lamp envelope;

a light emitting element attached to one of opposite ends of the metal foil and disposed in the light emitting tube portion; and an outer lead rod attached to the other end of the metal foil and led out of the seal portion, the seal structure comprising a separable layer configured to separate from a surface portion of the light emitting element interposed between the seal portion and a portion of the light emitting element embedded in the seal portion.

14. A seal structure of a lamp including:

a lamp envelope having a light emitting tube and seal portions;

a glass rod block embedded in the seal portion of the lamp envelope;

a light emitting element attached to one of opposite ends of the glass rod block and disposed in the light emitting tube;

an outer lead rod attached to the other end of the glass rod block and led out of the seal portion;

a metal thin film provided on a surface of the glass rod block for electrical connection between the light emitting element and the outer lead rod, the seal structure comprising a separable layer configured to separate from a surface portion of the light emitting element interposed between the seal portion and a portion of the light emitting element embedded in the seal portion.

15. A seal structure as set forth in claim 13 or 14, wherein an end portion of the glass seal or the glass rod block adjacent to the light emitting element is closed with a closure portion disposed in the seal portion of the lamp envelope.

* * * * *